US010837723B2

(12) United States Patent
Black et al.

(10) Patent No.: US 10,837,723 B2
(45) Date of Patent: Nov. 17, 2020

(54) SMART FIREARM

(71) Applicant: SAFEARMS LLC, Beavercreek, OH (US)

(72) Inventors: Terrell C. Black, Dayton, OH (US); Kevin S. Weaver, Kettering, OH (US); Ronald J. Miller, Sr., Beavercreek, OH (US); Arijit Sengupta, Beavercreek, OH (US); James A. Good, Centerville, OH (US)

(73) Assignee: SAFEARMS LLC, Beavercreek, OH (US)

( * ) Notice: Subject to any disclaimer, the term of this patent is extended or adjusted under 35 U.S.C. 154(b) by 0 days.

(21) Appl. No.: 16/525,797

(22) Filed: Jul. 30, 2019

(65) Prior Publication Data

US 2020/0109905 A1 Apr. 9, 2020

Related U.S. Application Data

(63) Continuation-in-part of application No. 15/206,576, filed on Jul. 11, 2016, now Pat. No. 10,365,057.

(60) Provisional application No. 62/235,050, filed on Sep. 30, 2015, provisional application No. 62/190,518, filed on Jul. 9, 2015.

(51) Int. Cl.

| | |
|---|---|
| ***F41A 17/00*** | (2006.01) |
| ***F41A 17/06*** | (2006.01) |
| ***G08B 13/24*** | (2006.01) |
| ***G08B 15/00*** | (2006.01) |

(52) U.S. Cl.

CPC ..... *F41A 17/063* (2013.01); *F41A 17/066* (2013.01); *G08B 13/2448* (2013.01); *G08B 15/004* (2013.01)

(58) Field of Classification Search

CPC ..... F41A 17/063; F41A 17/066

See application file for complete search history.

(56) References Cited

U.S. PATENT DOCUMENTS

2017/0010062 A1* 1/2017 Black ..... F41A 17/063

* cited by examiner

*Primary Examiner* — J. Woodrow Eldred

(74) *Attorney, Agent, or Firm* — Wood Herron & Evans LLP

(57) ABSTRACT

Systems and methods for controlling a firearm. Components embedded in a portion of the firearm enable the firearm to determine if a user of the firearm is authorized to do so, and either enable or disable a firing mechanism of the firearm accordingly. The firearm may also send communication signals regarding the status of the firearm or events detected by the firearm to a remote device controlled by an authorized user. The system may thereby notify the authorized user of attempted unauthorized use of the firearm, that the firearm has been left behind by the authorized user, or that the firearm is being tampered with. The system may also include multi-tag or a voice-override features that prevent the firearm from being used against the authorized user should the authorized user lose control of the firearm.

8 Claims, 13 Drawing Sheets

SMART FIREARM

CROSS-REFERENCE TO RELATED APPLICATIONS

This application is a continuation-in-part of U.S. application Ser. No. 15/206,576, filed Jul. 11, 2016, claiming the benefit of U.S. Application No. 62/235,050, filed Sep. 30, 2015, and U.S. Application No. 62/190,518, filed Jul. 9, 2015. Each of these applications is incorporated by reference herein in its entirety.

TECHNICAL FIELD

This disclosure generally relates to systems and methods of use for firearms and, more specifically, to systems and methods of use for smart firearm technologies.

BACKGROUND

Firearm technology includes many different types of firearms, including automatic and semi-automatic weapons, handguns, shotguns, rifles, etc. Conventional mechanical mechanisms to provide safety to such firearms may include, for example, trigger guards to protect against accidental use of a trigger that would otherwise initiate firing of the firearm. Other mechanisms may also be used to enhance firearm safety, such as user activated mechanical safeties that prevent accidental discharge of the firearm.

While these mechanisms provide improved safety, a need still exists for other alternative systems and methods to assist with firearm safety and the safe use of firearm technologies.

SUMMARY

In an embodiment of the invention, a system for controlling a firearm is provided. The system includes one or more processors and at least one memory operably coupled to the one or more processors. The at least one memory includes program code that, when executed by the one or more processors, causes the system to transmit a wireless signal from one of the firearm or a remote device, and receive the wireless signal at the other of the firearm or the remote device. The program code further causes system to determine, based on a strength of the received wireless signal, whether the firearm is more than a threshold distance from the remote device, and, in response to determining the firearm is more than the threshold distance from the remote device, cause the remote device to emit an alarm.

In another embodiment of the invention, a method of controlling the firearm is provided. The method includes transmitting the wireless signal from one of the firearm or the remote device, receiving the wireless signal at the other of the firearm or the remote device, determining, based on the strength of the received wireless signal, whether the firearm is more than the threshold distance from the remote device, and in response to determining the firearm is more than the threshold distance from the remote device, causing the remote device to emit the alarm.

In another embodiment of the invention, another system for controlling a firearm is provided. This system includes the firearm and an electronic tag including a unique identification associated with an authorized user. The firearm includes a battery, a locking device, and a firing mechanism that is disabled when the locking device is engaged so that the firearm cannot be fired and that is enabled when the locking device is disengaged so that the firearm can be fired.

The firearm further includes a processor that receives power from the battery and that is operably coupled to the locking device, and a memory operably coupled to the processor. The memory includes program code that, when executed by the processor, causes the firearm to, while the battery is not in a low battery condition, operate in an active mode during which the firearm transmits an interrogation signal configured to elicit a response from the electronic tag, disengages the locking device if the electronic tag responds to the interrogation signal, and engages the locking device if the electronic tag does not respond to the interrogation signal. In response to detecting the low battery condition, the program code causes the firearm to switch from the active mode to one of a forced enable mode or a forced disable mode. While the firearm is in the forced enable mode, the locking device remains disengaged so that the firearm can be fired, and while in the firearm is in the forced disable mode, the locking device remains engaged so that the firearm cannot be fired.

In another embodiment of the invention, another method for controlling the firearm is provided. This method includes, while the battery is not in the low battery condition, operating the firearm in the active mode during which the firearm transmits the interrogation signal configured to elicit the response from the electronic tag, disengages the locking device if the electronic tag responds to the interrogation signal, and engages the locking device if the electronic tag does not respond to the interrogation signal. In response to detecting the low battery condition, the method switches the firearm from the active mode to one of the forced enable mode or the forced disable mode. While the firearm is in the forced enable mode, the locking device remains disengaged so that the firearm can be fired, and while in the firearm is in the forced disable mode, the locking device remains engaged so that the firearm cannot be fired.

In another embodiment of the invention, another system for controlling a firearm is provided. This system includes the firearm, a first electronic tag including a first unique identification associated with an authorized user, and a second electronic tag including a second unique identification associated with the authorized user. The firearm includes a locking device, a firing mechanism that is disabled when the locking device is engaged so that the firearm cannot be fired, and that is enabled when the locking device is disengaged so that the firearm can be fired, a processor operably coupled to the locking device, and a memory operably coupled to the processor. The memory includes program code that, when executed by the processor, causes the firearm to transmit one or more interrogation signals configured to elicit a first response from the first electronic tag and a second response from the second electronic tag, disengage the locking device if both the first electronic tag and the second electronic tag respond to the one or more interrogation signals, and engage the locking device if either of the first electronic tag or the second electronic tag does not respond to the one or more interrogation signals.

In another embodiment of the invention, another method for controlling the firearm is provided. This method includes transmitting, from the firearm, the one or more interrogation signals configured to elicit the first response from the first electronic tag and the second response from the second electronic tag, disengaging the locking device if both the first electronic tag and the second electronic tag respond to the one or more interrogation signals, and engaging the locking device if either of the first electronic tag or the second electronic tag does not respond to the one or more interrogation signals.

In another embodiment of the invention, another system for controlling a firearm is provided. This system includes the firearm and an electronic tag including a unique identification associated with an authorized user. The firearm includes a locking device, a firing mechanism that is disabled when the locking device is engaged so that the firearm cannot be fired, and that is enabled when the locking device is disengaged so that the firearm can be fired, a processor operably coupled to the locking device, and a memory operably coupled to the processor. The memory includes program code that, when executed by the processor, causes the firearm to determine if a voice command has been received from the authorized user. If the voice command has been received from the authorized user, the program code causes the firearm to determine if the voice command includes an instruction to engage or disengage the locking device. In response to the voice command including the instruction to engage the locking device, the program code causes the firearm to engage the locking device. In response to the voice command including the instruction to disengage the locking device, the program code causes the firearm to disengage the locking device. If the voice command has not been received from the authorized user, or does not include the instruction to engage or disengage the locking device, the program code causes the firearm to transmit an interrogation signal configured to elicit a response from the electronic tag, disengage the locking device if the electronic tag responds to the interrogation signal, and engage the locking device if the electronic tag does not respond to the interrogation signal.

In another embodiment of the invention, another method for controlling the firearm is provided. This method includes determining if the voice command has been received from the authorized user at one of the firearm or the remote device. If the voice command has been received from the authorized user, the method determines if the voice command includes the instruction to engage or disengage the locking device. In response to the voice command including the instruction to engage the locking device, the method engages the locking device, and in response to the voice command including the instruction to disengage the locking device, the method disengages the locking device. If the voice command has not been received from the authorized user, or does not include the instruction to engage or disengage the locking device, the method transmits, from the firearm, the interrogation signal configured to elicit the response from the electronic tag including the unique identification associated with the authorized user, disengages the locking device if the electronic tag responds to the interrogation signal, and engages the locking device if the electronic tag does not respond to the interrogation signal.

The above summary presents a simplified overview of some embodiments of the invention to provide a basic understanding of certain aspects of the invention discussed herein. The summary is not intended to provide an extensive overview of the invention, nor is it intended to identify any key or critical elements, or delineate the scope of the invention. The sole purpose of the summary is merely to present some concepts in a simplified form as an introduction to the detailed description presented below.

BRIEF DESCRIPTION OF THE DRAWINGS

The accompanying drawings, which are incorporated in and constitute a part of this specification, illustrate various embodiments of the invention and, together with the general description of the invention given above, and the detailed description of the embodiments given below, serve to explain the embodiments of the invention.

DETAILED DESCRIPTION

According to an embodiment of the invention, a firearm includes smart components embedded into a portion of the firearm, such as a grip portion, that are communicatively coupled to components that are remote to the firearm to implement a smart firearm technology. The term "smart" as used herein refers to use of technologies incorporating various communicatively coupled components to electronically communicate between a firearm and remote devices, such as a mobile phone or other communication device, and to automatically control one or more firearm functionalities, whether internally or from the remote components. For example, use of such smart components may permit the firearm to display or send alerts regarding status updates (such as power levels of a battery, indication of need of maintenance, or status of enablement or disablement).

Further, use of such smart components may permit the firearm to recognize authorized users to permit one or more firearm operations. Embodiments of the invention may also allow the firearm to be tracked via inventory control tags, to communicate with remote devices, such as a mobile phone, or to charge an internal power supply. Embodiments of the invention may prevent unauthorized tampering, or enable voice control operations. Still further, embodiments of the invention may be used to inject a destructive solution into the firearm, based on unauthorized use or possession of the firearm, to permanently destroy the functionality of the firearm. Various embodiments of the smart firearm and the operation of the smart firearm are described in more detail below.

Figure 1:
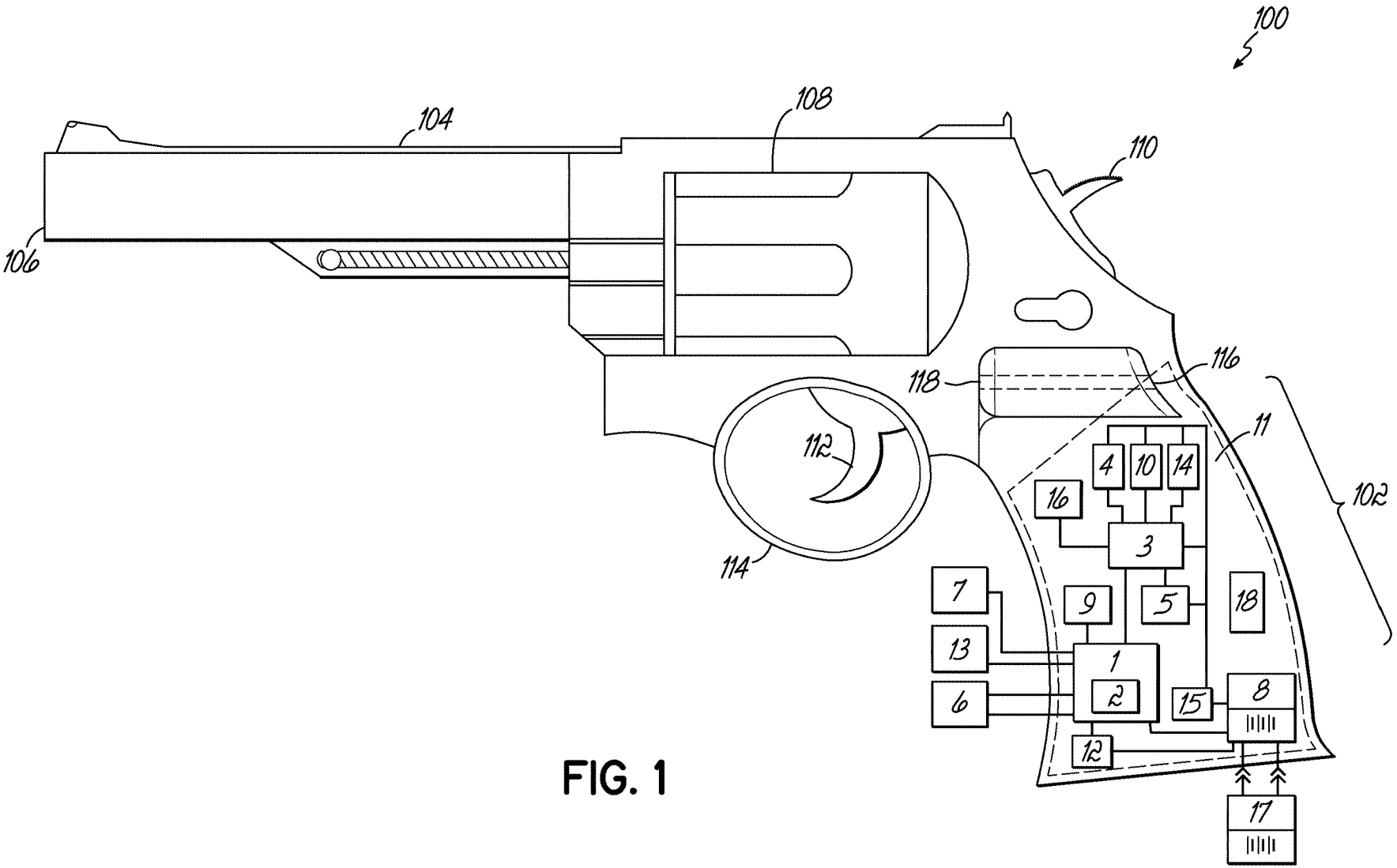
FIG. 1 is a diagrammatic view of an exemplary smart technology system for controlling a firearm according to an embodiment of the invention.

Referring to FIG. 1, an exemplary firearm 100 such as a handgun may include a grip portion or "grip" 102, a barrel 104 ending in a muzzle 106 through which a bullet may exit, and a cylinder 108 that holds one or more bullets in separate chambers and that rotates to align those chambers with the barrel 104 as the firearm 100 is being prepared to fire a bullet. The firearm 100 may further include a hammer 110 that strikes an internal firing pin or cartridge primer directly to detonate the primer and discharge the firearm 100. A trigger 112, when pulled, may initiate a firing process that propels the bullet through the barrel 104 and out of the muzzle 106. A trigger guard 114 may wrap around the trigger 112 to prevent the trigger 112 from accidentally being engaged. The firearm 100 may further include a rearward facing camera 116 and a forward facing camera 118, as described in further detail below. While the firearm 100 is illustrated as a revolver in FIG. 1, other types of firearms, such as semi-automatic and automatic handguns, rifles, or shotguns are also within the scope of this disclosure. Thus, the illustrated example is not limiting to embodiments of the invention.

Figure 2:
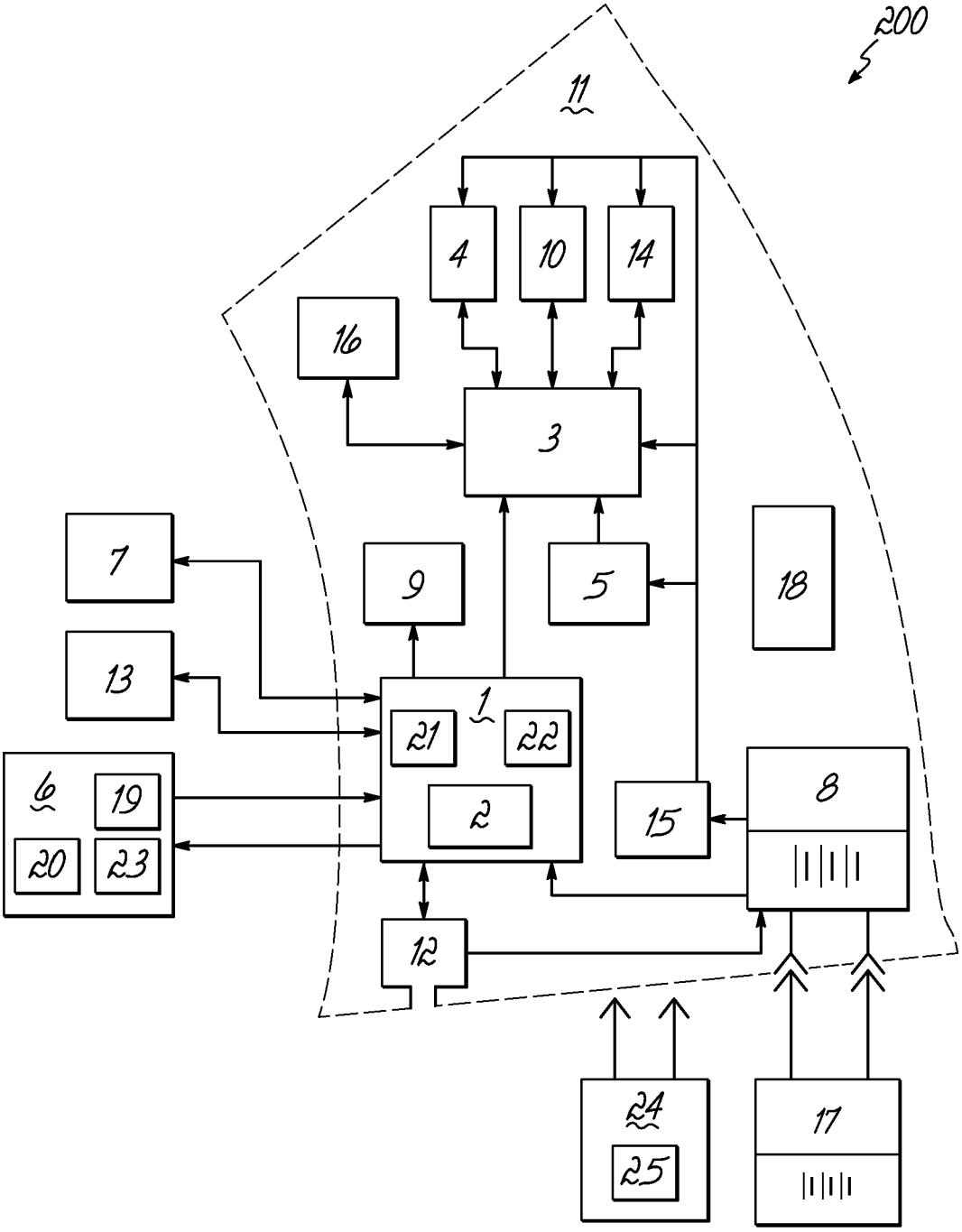
FIG. 2 is a diagrammatic view of a grip portion of the exemplary firearm of FIG. 1 showing details of the smart technology system for implementing a computer and software based method to monitor or control the firearm using the components embedded in the grip portion thereof, a remote device, or one or more electronic tags.

Referring now to FIG. 2, and with continued reference to FIG. 1, one or more components of the smart technology system 200 may be embedded within the grip 102 of firearm 100. Various components of the system 200 as described herein may be located in the firearm 100. While the components of the system 200 located in the firearm 100 are shown as primarily embedded within the grip 102, it should be understood that some portions of the system 200 may also be located within other portions of the firearm 100.

The system 200 may include elements and components that are embedded in the grip 102 or some other portion of the firearm 100, and components communicatively coupled to the embedded components that may be remotely positioned from the embedded components of the grip 102. The system 200 may include a processor 1 (e.g., a microcontroller) and an Input/Output (I/O) board 3 having built-in sensors, a camera, or feedback devices, for example.

The processor 1 may include an Advanced Reduced Instruction Set Machines (ARM), ARM-based, or other suitable central processing unit (CPU) capable of running Android 4.4 or later technologies. The processor 1 may include a global positioning system (GPS) or the functionality to interface with a separate GPS system or GPS system components. In a further embodiment, the system 200 may include a haptic device that provides user feedback through a vibration actuator which generates vibrations. In a further embodiment, the system 200 may include a speaker to provide audio feedback, and a microphone to receive audio input.

In a further embodiment, the system 200 may include a motion detection device, such as an accelerometer that is configured to measure motion of the firearm 100. The accelerometer may make measurements along three separate axes of motion. In further embodiments, the accelerometer may include functionality to measure motion along six axes, e.g., three-axes of linear acceleration and three axes of angular acceleration.

The processor 1 may be configured to interface with and to control a data communications service (e.g., a general packet radio services (GPRS)-based service or other suitable wireless data communication protocol) using a communication device that is configured to provide text, talk, or data services. The processor 1 may be configured to interface with and to further control a Bluetooth Low Energy (BLE) system that is configured to send and receive information using wireless signals. Bluetooth is a wireless communication standard maintained by the Bluetooth Special Interest Group, which is a standards organization having a headquarters at Kirkland, Wash., United States. Additional functionality may include a general purpose I/O interface, such as a generic pin on an integrated circuit. The general purpose I/O interface may include one or more I/O interface components such as the I/O board 3 or a communication port 12. A camera (e.g., rearward facing camera 116 or forward facing camera 118) may also be part of the system 200 and be used to capture activities and environmental conditions during activation or live fire of the firearm 100. The system 200 may include standard camera sensors (e.g., in the rearward or forward facing cameras 116 and 118) capable of recording SD-quality videos (Standard-Definition) and at least 2MegaPixel images. Cameras may be augmented with infrared lighting capabilities for low-light applications. The cameras may be Universal Serial Bus (USB) or Wireless versions. USB is an industry standard maintained by the USB Implementors Forum of Beaverton, Oreg., United States. According to an embodiment of the invention, the cameras may be directly wired to camera ports on the I/O board 3.

A memory 21 may include a volatile or nonvolatile computer readable medium that is operationally coupled with the processor 1 and may include a random access memory (including SRAM, DRAM, and other types), flash memory, registers, disks, or other types of storage components. Additionally, the memory 21 may be configured to store, among other things, computer readable instructions, one or more look-up tables, and any data necessary to monitor or control the functionalities of the firearm 100. The processor 1 may function as a processor configured to execute instructions stored on the memory 21. Additionally or alternatively, the one or more look-up tables or other data may be stored in an onboard database 22 communicatively coupled to or located in the memory 21. The memory 21 and onboard database 22 may be separate components or may be integrated as part of processor 1. In any case, it should be understood that the lines and schematic orientations depicted in FIG. 2, such as between the processor 1 and other embedded and non-embedded components of the system 200, are indicative or illustrative of operative connections and paths of communications, and therefore do not necessarily indicate physical connections between various components.

As described in greater detail below, embedded components of the system 200 may include an application 2, the I/O board 3, and an electro-mechanical locking device 4. The system 200 may further comprise a reading device 5 configured to communicate using one or more of a Near-Field Communication (NFC), Radio-Frequency Identification (RFID) protocol, or any other suitable protocol, and a main power supply 8. The main power supply 8 may comprise a battery or other energy storage device. The system 200 may further comprise a light-emitting diode (LED) 9 that is configured to provide visual feedback to a user of the firearm 100. For example, the LED 9 may be illuminated in one color to indicate the firearm 100 is in one mode and illuminated in another color to indicate the firearm 100 is in another mode, etc. That is, various colors may indicate various corresponding modes.

The system 200 may further comprise a capsule injector 10 that is configured to release a destructive solution rendering the firearm 100 permanently dysfunctional, and the communication port 12, which may be a port configured to send and receive data signals. The communication port 12 may also be configured to receive electrical power from an external source thereof and transmit the received power to the main power supply 8. The communication port 12 may comprise, for example, a USB or other suitable interface that enables the portion of system 200 in the firearm 100 to communicate or exchange power with other computing devices, power supplies, or system components. According to an embodiment of the invention, the system 200 may further comprise one or more of a maintenance latching device 14, a power switch 15, a tamper detection switch 16, and an inventory control tag 18.

Non-embedded components of the system 200 may include an external application or messaging system for remote control and monitoring of the firearm 100, such as a remote device 6. The remote device 6 may include a processor 19, a memory 20, and an application 23 comprising program code stored in the memory 20 that is executed by the processor 19. The system 200 may further comprise a primary electronic tag, such as Radio Frequency Identification (RFID) tag 13 (which may be associated with reading device 5), a secondary identification device 7 (which may comprise a secondary electronic tag, such as another RFID tag or external active tag for secondary activation, e.g., a Bluetooth Technology (BTT) tag), and an auxiliary battery 17. The system 200 may also include a charging device 24 configured to charge the main power supply 8 when the firearm 100 is coupled to the charging device 24, e.g., through a battery port, the communication port 12, or wirelessly using a wireless charging interface such as Qi, which is an open wireless charging standard maintained by the Wireless Power Consortium of Piscataway, N.J. The charging device 24 may include an electronic tag 25 (e.g., an RFID tag) including a unique identification that enables the firearm 100 to determine if it has been connected to a known charging device 24. A security enclosure or cover 11 may be used to conceal and secure the portions of grip 102 that include the embedded components of the system 200.

One or more of the applications 2, 23 may operate independently or cooperatively to control the system 200, and be embedded and run as a service on the processor 1 of firearm 100 or the processor 19 of remote device 6, respectively. The applications 2, 23 may control the functionality of the components of the system 200 as described herein, and may be implemented using hardware, software, firmware, tangible computer readable media having instructions stored thereon, or a combination thereof, and may be implemented in one or more computer systems or other processing systems, as described in greater detail below, such as with respect to FIG. 14.

The I/O board 3 may comprise I/O hardware that provides an internal supplemental I/O interface board which is capable of handling general purpose I/O signals, including serial transistor-transistor logic (TTL), standard TTL-based digital inputs and outputs, and pulse-width-modulation (PWM) outputs. A number of available input and output pins may depend on the features implemented in the system 200 and the components used for the I/O interface. The I/O board 3 may include hardware or software for sending data to and receiving data from an external device, such as an output signal corresponding to authentication of a user in close proximity, e.g., from an RFID tag. Exemplary I/O hardware for the I/O interface may include, but is not limited to, USB, FireWire, Thunderbolt, local area network (LAN) ports, wireless fidelity (Wi-Fi) cards, Imax cards, or any other suitable hardware for communicating with other networks or external devices. The I/O board 3 may thereby provide a machine interface that operably couples the processor 1 to other devices and systems, either external or internal to the firearm 100, such as the locking device 4, reading device 5, capsule injector 10, latching device 14, and tamper detection switch 16. The I/O board 3 may also include a transceiver or other circuitry for communicating wirelessly with external devices, such as the remote device 6, RFID tag 13, electronic tag 25, a wireless network access point, a cellular network base station, or any other suitable external devices. The application 2 may thereby work cooperatively with the remote device 6, secondary identification device 7, RFID tag 13, electronic tag 25 or other external devices to provide the various features, functions, applications, processes, or modules comprising embodiments of the invention. The RFID tag 13 may be located on the person of the user (e.g., in a wrist band or ring), or embedded in a location where the firearm 100 is often left or stored (e.g., a charging device), and may include a unique identification, such as a universally unique identifier (UUID). The application 2 may use the unique identification to determine what mode the system 200 should be operating in, e.g., by comparing the unique identification to a table of identities in the onboard database 22 to determine if the firearm 100 is in the possession of an authorized user or located in a known location, such as the home of an authorized user.

The locking device 4 or locking feature of embodiments of the invention may securely block operation of the firing mechanism, such as by preventing the trigger 112 from being pulled or the hammer 110 from impacting the firing pin, thereby preventing the firearm 100 from being discharged. For example, the firearm 100 may be defaulted to a disabled, locked state in which the firearm 100 is not functional to fire. The locking device 4 may prohibit functionality of the firearm 100 by disabling the mechanical components of the firearm 100 that are required to discharge the firearm 100. That is, if the trigger 112 is pulled, the gun will not fire. When the firearm 100 is in an enabled or unlocked state, the locking device 4 may be disengaged and the firearm 100 in a firing condition in which the functionality to fire a bullet is enabled. The system 200 allows firearm 100 to be moved selectively between an enabled and a disabled status.

The remote device 6 may control or monitor the firearm 100 through a protocol designed to remotely send and receive messages to and from the processor 1. A two-way messaging protocol may be sent over a Short Messaging System (SMS) or a user-friendly interface such as a graphical user interface (GUI). The SMS functionality GUI may be run or displayed on a remote device such as a smart phone or other smart device.

The main power supply 8 may provide power to various components of the system 200 such as the I/O board 3, locking mechanisms such as locking device 4, and internal tag readers such as the reading device 5. The power switch 15 may be an externally accessible power switch usable to turn off the power to the I/O interface or I/O board 3 to save battery life. The processor 1 may continue to run (e.g., using power from the main power supply 8 or a secondary power source, such as the communication port 12 or the auxiliary battery 17) to continue monitoring the firearm 100 when the power switch 15 is engaged turning off power to the I/O board 3. The auxiliary battery 17 may be a generally small external battery that is configured to snap into a corresponding battery port of the firearm 100, or otherwise integrate with the firearm 100, to provide an alternate source of power when the firearm 100 is experiencing a low battery condition.

The communication port 12 may include a male connector port that links to a female connector port or opening of the firearm 100 or a peripheral device having a mating female port or plug portion. The communication port 12 may be used to upload or download information in the form of data to and from the processor 1, the onboard database 22, or other memory components of the firearm 100. The communication port 12 may also be used to recharge a battery onboard the firearm 100. The batteries or other elements of main power supply 8 may be recharged using the communication port 12. A charging device may include a first and second male plug portions at opposite ends. The first male plug portion may include a 120 volt plug (connected to by another USB male connector port end, for example) that can be inserted into a standard outlet, and the second male plug portion may be a male connector port that is configured to be received in the female connector port of the firearm 100.

The firearm 100 may further include a wireless battery charging device that charges the battery of main power supply 8 when the wireless battery charging device communicates with a corresponding external wireless battery charging device. In this regard, the internal battery may act as the main power supply 8 for the system 200. The system 200 may further include an auxiliary battery 17 that snaps into a receiver on the firearm 100 to act as an alternate power source when the battery of the main power supply 8 runs low. Besides being rechargeable via the communication port 12, both the main power supply 8 and the auxiliary battery 17 may be Qi compatible and therefore may be recharged wirelessly when laid on a charging pad similar to what is used with a mobile phone.

Information in the form of data may be uploaded to or downloaded from memory within the firearm 100 by inserting the male connector of a USB cable into the female connector of the communication port 12 of firearm 100 and connecting another connector of an opposite end of the USB cable into a peripheral device such as a computer or mobile device. Data may also be retrieved from the firearm 100 via a cellular or other mobile network associated with the remote device 6 using the remote application 23 if the remote device 6 has a valid cellular signal and is connected to an authorized cellular network, for example. The remote device 6 may be implemented as an external device that sends commands to the firearm 100 and receives data and information from the firearm 100. The remote device 6 may run an operating system such as Android 4.4 (or any other suitable operating system), and may utilize a unique application 23 to remotely control the functionality of the firearm 100. The remote device 6 may be configured to function like a smart phone that runs a software application which allows the user to configure how the system 200 operates to the user's preference via a GUI or other method. For example, the remote device 6 may send commands to the firearm 100 via text messaging using cellar communication.

The reading device 5 may be incorporated into the grip 102 of firearm 100 to read tags for authentication, such as one or more RFID tags 13 or electronic tag 25 of charging device 24. The RFID tags 13 may be electronic labels that include an antenna, an integrated circuit chip including a memory which stores a unique identification, and a substrate that holds the tag components together. The RFID tag 13 may be external to the firearm 100 and may be used to identify an authorized user such as an individual who is authorized to access and use the firearm 100. According to an embodiment of the invention, the RFID tag 13 may be a high-frequency tag using a 13.56 MHz carrier frequency. The unique identification stored in the RFID tag 13 may be assigned to an authorized user and stored in the onboard database 22 to allow the processor 1 to determine if the RFID tag 13 is a valid RFID tag 13. A valid RFID tag 13 may allow a customizable level of control (e.g., full control or partial control) of the firearm 100.

In operation, when the RFID tag 13 is within a close proximity of the firearm 100, the reading device 5 may sense the presence of the RFID tag 13 and establish communication between the reading device 5 and the RFID tag 13. The reading device 5 may read the unique identification encoded within the RFID tag 13 and send this information to the processor 1 for authentication. The processor 1 may attempt to authenticate the RFID tag 13 by comparing the unique identification stored on the RFID tag 13 to one or more authorized identities stored in the onboard database 22 to determine if the RFID tag 13 is valid. If the processor 1 authenticates the RFID tag 13 as valid, the processor 1 may grant authorization for the functionality of the firearm 100 to be unlocked and enabled by sending a signal to the locking device 4 that unlocks and enables the firing mechanism of the firearm 100. The processor 1 may also simultaneously activate the LED 9 to glow a color (e.g., green) to reflect a firing enabled status of the firearm 100.

If the processor 1 does not authenticate the RFID tag 13 as valid and rather determines the RFID tag 13 to be invalid, the locking device 4 may remain in a disabled, locked position, in which case the firearm 100 will not be functional. In this disabled, locked position, the LED 9 may glow another color (e.g., red) to reflect the firing disabled status of the firearm 100. According to an embodiment of the invention, the application 23 that runs in the remote device 6 as well as the application 2 that runs in the firearm 100 may both have the capability to receive and act on voice instructions verbalized by an authorized user. The portions of the system 200 in the firearm 100 or the remote device 6 may utilize voice biometrics for this purpose to authenticate that the user who is verbalizing the instruction is indeed an authorized user of the firearm 100. If the portion of the system 200 in the firearm 100 or in the remote device 6 authenticates the user's voice as the authorized user, then the system 200 may execute the command that was verbally communicated. According to an embodiment of the invention, the user can verbally communicate instructions directly to the firearm 100 or the user can verbally communicate instructions through the remote device 6. The verbal instructions, among other things, may be used to change the state, or mode, of the firearm 100. Exemplary modes may include, but are not limited to "Home", "Away", "Ready", "Maintenance", "Destruct", "Forced Enable", "Forced Disable", and "Left Behind" modes.

The Ready mode may be a default mode which is entered when the processor 1 is initially powered up. While in the Ready mode, the firearm 100 may be ready to receive a command or signal, e.g., a voice command from an authorized user, or a signal from the remote device 6, secondary identification device 7, RFID tag 13, or electronic tag 25. In the absence of a command or signal that requires the locking device 6 to be disengaged, the processor 1 may cause the locking device 6 to be engaged so that the firearm 100 is maintained in a locked state. In response to receiving a command or signal that requires the locking device 6 to be disengaged (e.g., detecting the presence of the RFID tag 13), the processor 1 may cause the locking device 4 to be disengaged so that the firearm 100 is maintained in an unlocked state. Engaging or disengaging the locking device 4 may not require any changes to the state of the locking device 4 if the locking device 4 is already in the respective state. If, on the other hand, the locking device 4 is not currently in the respective state, engaging or disengaging the locking device 4 may include activation of a solenoid or other device that changes the state of the locking device 4 to the respective state. Thus, the processor 1 may engage or disengage the locking device 4 by maintaining the locking device 4 in its current state when the current state matches the commanded state, or by activating a device to change the state of the locking device 4 when the current state does not match the commanded state.

The firearm 100 may also provide an indication to the user when the firearm 100 enters a locked or unlocked state while in the Ready mode. For example, when entering an unlocked state from a locked state in response to detecting the presence of RFID tag 13, indications may include causing the LED 9 to flash in a particular way or to emit a particular color, or by emitting an audible signal from the firearm 100, such as a tone or a voice greeting, e.g., "welcome <user name>". The firearm 100 may provide another indication when it transitions from the unlocked state to the locked state (e.g., in response to no longer detecting the presence of the RFID tag 13), such as by causing LED 9 to flash in another particular way or emit another particular color, or by emitting another audible signal indicating the locking device 4 is in a locked state and ready to receive a command or signal.

Figure 11:
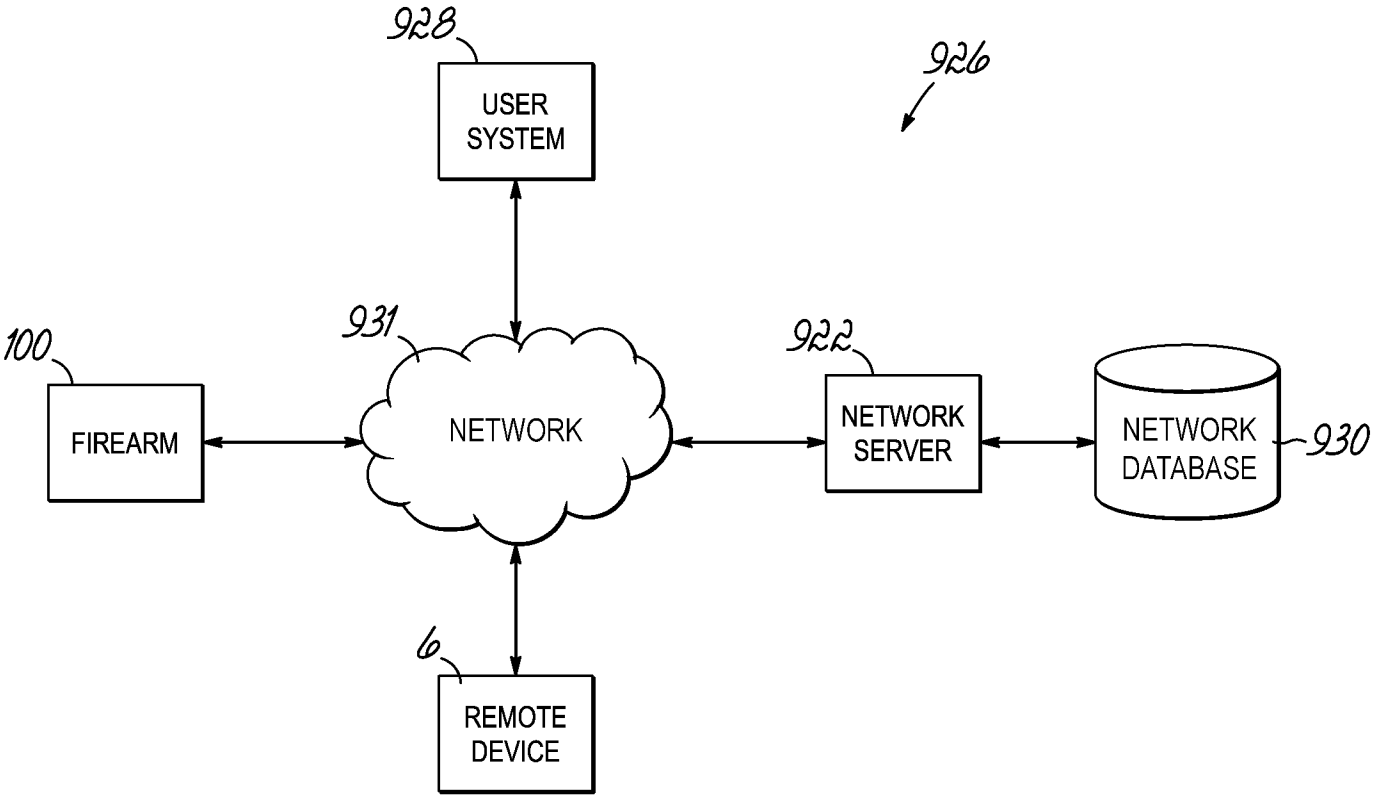
FIG. 11 is a diagrammatic view of an exemplary operating environment of the smart technology system of FIG. 2 including a network, a network server, and a network database.

The firearm 100 may include the rearward facing camera 116 pointing in a backward direction that captures images of a person holding the firearm 100 and the forward facing camera 118 pointing in a forward direction that captures images of objects in a direction in which the firearm 100 is pointed. The rearward and forward facing cameras 116, 118 may be configured to transmit images wirelessly to an external network or device, such as the remote device 6 or a network server 922, e.g., for storage in a network database 930 (FIG. 11). The firearm 100 may further include a laser sight that assists the user in aiming the firearm 100 at an intended target. The laser sight may be configured to be activated only by an authorized user. Therefore, the laser sight might be controlled along with the firing mechanism of the firearm 100.

Occasionally, the electrical components and mechanical parts of the firearm 100 may require maintenance, and certain of those components and parts may be embedded in the grip 102 and secured by the cover 11 that acts as a security enclosure which may require authorization to be accessed. The RFID tag 13 may be coded to permit such access to the secure area of the grip 102 that is covered by cover 11 to permit such service and repair. As described above, the processor 1 may authenticate the RFID tag 13 by comparing its unique identification to one or more authorized identities included in the onboard database 22 to determine if the RFID tag 13 is valid and is permitted to enable access to the area secured by cover 11, e.g., for service and repair of the firearm 100.

Once the processor 1 authenticates the presence of a valid RFID tag 13 for such service and repair, the processor 1 may send power from main power supply 8 to the maintenance latching device 14 to open cover 11 and permit access to the secure area of the grip 102. The maintenance latching device 14 may be an electro-mechanical latch that can be activated by a remote protocol command or a specifically encoded RFID tag 13, as described above. Activation of the maintenance latching device 14 may allow the firearm 100 to be disassembled for maintenance purposes, for example. The maintenance latching device 14 may further simultaneously power the LED 9 to glow a color (e.g., blue) to indicate maintenance activation and that an authorization was granted to access the secure area under the cover 11.

To provide access to this secure area upon such authorization, the maintenance latching device 14 may retract a locking pin that passes through a bottom portion of the cover 11 and into a locking tab attached to an inside area of the cover 11. After the locking pin is retracted, the cover 11 may be removed to gain access to the electrical and mechanical components of the grip 102 for service and repair. If the RFID tag 13 is read as invalid for such permissions, access to the secure area under the cover 11 may be denied and the area remain secured. In the event of a forced entry attempting to open the cover 11 to access the underlying secured area, the tamper detection switch 16 may send a notification to the processor 1, which may send alerts to one or more authorized users of the unauthorized entry and attempted access condition. For example, the tamper detection switch 16 may be an internal tamper micro switch that is used to send one or more alarm messages via the processor 1 and the remote device 6 to a user (e.g., by sending a text message) when an unauthorized attempt is made to disassemble the firearm 100.

The secondary identification device 7 may be used as a secondary safety activation device such that, if enabled, the firearm 100 unlocks only when in proximity of both an authorized secondary identification device 7 and an authorized RFID tag 13. The system 200 may be configured so that only one particular pairing of a specific authorized secondary identification device 7 and a specific authorized RFID tag 13 allows the firearm 100 to function, or may be configured so that multiple combinations of one or more authorized secondary identification devices 7 and one or more authorized RFID tags 13 allow the firearm 100 to function. The secondary identification device 7 may be BLE tag, an RFID tag, an NFC tag, or any other suitable electronic tag, and may be button shaped with a built-in coin cell battery. The inventory control tag 18 may be an Ultra High Frequency (UHF) RFID tag that operates in a range of from about 860 MHz to about 960 MHz, for example, to identify the firearm 100 for inventory control or other administrative purposes. Use of a UHF RFID tag may prevent interference with the reading device 5, and may extend an inventory read range.

The LED 9 may include one or more semiconductor diodes that glow when a voltage is applied and may be used to indicate a functional state or status of the firearm 100. For example, a low battery condition of the firearm 100 may be assigned a color such as yellow, and the LED 9 may glow yellow when the firearm 100 has a low battery condition. As other examples and not limitations, the LED 9 may glow red when the firearm 100 has been disabled, green when the firearm 100 has been enabled, or blue when the firearm 100 is due to undergo maintenance. The LED 9 may glow other colors to indicate other corresponding conditions.

If the firearm 100 is lost or stolen, it may be tracked or located remotely utilizing the remote device 6. In this regard, location tracking may be accomplished by using the GPS/cellular location of the firearm 100 retrieved via cellular messaging. The firearm 100 may employ a GPS capability that is embedded into the processor 1 which includes a data transponder to track a physical location of the firearm 100, stores the location information in the memory 21, and transmits the stored tracking data to the user via the remote device 6.

The capsule injector 10 for permanently disabling the firearm 100 may be an electro-mechanical injection device that contains a capsule which holds and releases a destructive solution rendering the firearm 100 permanently dysfunctional. The capsule injector 10 may be remotely driven such that the firearm 100 is subject to a remote access protocol to remotely destroy the functionality of the firearm 100, as described herein. For example, if the firearm 100 is lost or stolen, as an additional or alternative to using the remote device 6 to track the firearm 100, the capsule injector 10 may be remotely instructed to deliver an amount of a destructive solution such as a two-part epoxy or other similar agent contained in a gel-capsule that is capable upon release of producing irreparable damage to one or more mechanical components of the firearm 100. The destructive solution may, for example, employ an agent capable of permanently freezing the hammer 110 or other component of the firing mechanism of the firearm 100 such that the firearm 100 is rendered incapable of firing. According to an embodiment of the invention, the capsule injector 10 may be operably coupled with the I/O board 3 and processor 1 for enabling remote control of the capsule injector 10 via the remote device 6. The capsule injector 10 may include a mechanism that comprises a solenoid, that when activated by a command from the authorized user, pushes a pin to permeate a gel-capsule containing the destructive solution, releasing the destructive solution and rendering the firearm 100 inoperable.

A menu-driven user interface on at least one of the firearm 100 and the remote device 6 may permit an authorized user to tailor options regarding functionalities for the firearm 100, wherein functions may be enabled or disabled by the user through use of a user-controlled remote device 6, and an appropriate graphical interface, for example. Among the other things described above, the remote device 6 may be used to change the state, or mode, of the firearm 100. Functions that may be enabled by the processor 1 in response to entering a mode may include, but are not limited to, a multi-tag reading capability, a sensory feedback notification, an internal diagnostics system, GPS tracking, internal tamper sensors, data collection on firearm usage and status, remote destruction of functionality of the firearm 100, or a voice biometric override option. One or more of the portions of the system 200 in the firearm 100 and the remote device 6 may utilize voice biometrics for this purpose and authenticate that the user who is verbalizing the instruction is indeed an authorized user of the firearm 100. If the portion of the system 200 in the firearm 100 or the remote device 6 authenticates the user's voice as the authorized user, then the system 200 may execute the command that was verbally communicated. The verbal instructions may, among other things, be used to change the state, or mode, of the firearm 100. In this regard, the user may verbally communicate instructions that will override any existing state directly to the firearm 100 or the user can verbally communicate override instructions through the remote device 6.

The multi-tag reading capability may read multiple tags to permit multiple authorizations to enable firing activations, to service the firearm 100, or perform other such control operations of the firearm 100. For example, by requiring that more than one tag in close proximity to the firearm 100 to place locking device 4 in an unlocked state, the multi-tag reading capability may enable an additional level of security. This additional level of security may be deployed such that the firearm 100 will only perform a predetermined authorized operation or functionality when in close proximity of both a previously identified secondary identification device 7 and a primary RFID tag 13. Close proximity for the secondary identification device 7 may correspond to a distance in the range of about ±5 feet, for example. In certain embodiments of the invention, the secondary identification device 7 may include a battery to provide an extended range for reading by the portion of the system 200 in the firearm 100, e.g., by enabling the secondary identification device 7 to transmit a beacon signal including its unique identification. This extended range may enable operation of the firearm 100 in an authorized area, such as a firing range, and disable the firearm 100 when it is transported outside of the authorized area.

The secondary identification device 7 may work jointly with the primary RFID tag 13. For example, in the event both the RFID tag 13 and the firearm 100 are taken from an authorized user by an unauthorized person, the secondary identification device 7 may remain with the authorized user, such as by being hidden within the authorized user's clothing. In such an instance, the secondary identification device 7 may prevent the RFID tag 13 from authorizing use of the firearm 100 if the secondary identification device 7 is not in close proximity to the firearm 100. For example, once the firearm 100 and the RFID tag 13 are with an unauthorized user and are more than a predetermined distance (e.g., 5 feet) from the authorized user wearing the secondary identification device 7, the unauthorized user may not be able to use the firearm 100.

By way of example, the system 200 may be configured to implement a dual-tag feature requiring a secondary simultaneous method of authorization so the that firearm 100 can only be discharged when both the primary tag and the secondary tag are in proximity to the firearm 100. In an embodiment of the invention, the primary tag may be the user's RFID tag 13, and the secondary tag may be the secondary identification device 7, which may be disguised as a button or similar inconspicuous item worn or otherwise in possession of the authorized user. As use of the smart technology system 200 becomes common for law enforcement, perpetrators may come to understand how or what makes the system 200 work. A user in a physical struggle with one or more individuals who overpower the authorized user and are knowledgeable enough to identify and take the firearm 100 and the RFID tag 13 could, absent an active dual-tag feature, obtain control of the firearm 100.

The secondary identification device 7 may be less noticeable than the primary tag, and therefore harder to locate and identify. This may be especially true if the secondary tag has the same appearance as other common items, such as a button. In this case, there is a high probability that the assailant will not take the time to search further once they believe they have the only component necessary to make the firearm 100 operational. The dual-tag feature may allow a user who is in immediate danger to remove themselves from the confrontation even if it means giving up the firearm 100 to do so. At this point the firearm 100 by itself will be inoperable with or without the primary tag. Moreover, the firearm 100 can be later permanently disabled by implementing the Destruct mode.

In an embodiment of the invention, the firearm 100 may provide sensory feedback to the user. The sensory feedback notifications may include a haptic, tactile notification such that the firearm 100 provides a touch-based alert, such as a series of vibrations that can be felt through the grip 102, when responding to an activation of the firearm 100. This sensory feedback may alert the firearm user that the firearm 100 firing operation or other functionality has been activated or enabled. A similar alert may occur when the functionality has been disabled. The system 200 may utilize a basic vibrator motor similar to that commonly utilized in a mobile phone, such as a purposely unbalanced motor that will cause vibrations instead of a smooth rotation.

Similar alerts may additionally or alternatively include audible alerts (such as using an internal buzzer or horn sound through a speaker to provide audible feedback to a user regarding such activation or other usage), visual alerts (such as use of the LED 9 or other visible color device to provide visual feedback to a user regarding a status of the firearm 100), or voice and speech alerts (such as use of internal speakers so the firearm 100 is able to provide audible voice or natural grammar feedback to the user upon such activation or other usage, such as by reading out the name of a user that has been authenticated and authorized to perform one or more operations on the firearm 100). The buzzer/horn sound may be transmitted through the system's 200 speaker that is built into the I/O board 3. In an embodiment of the invention, the speaker may be connected (e.g., soldered) directly to the I/O board 3.

The system 200 may also include an internal diagnostics system. The internal diagnostics system may include coded signals or audible alerts for items such as protocol violations, low battery indications, scheduled maintenance indications, or one or more component failures of the system 200. Once paired with the remote device 6, any protocol violations may result in alerts being sent to the remote device 6. Optional functionalities may include GPS tracking location systems, as described above, wherein the firearm 100 may be remotely located using a GPS chip embedded in the firearm 100. If lost, the firearm 100 may be remotely located using a combination of network and GPS-based location services, such as on a remote mobile device. The GPS system may defer to or be used in combination with a cellular or network location service when used for indoor tracking such that an approximate location may be obtained even where the GPS system faces obstructions as caused by indoor objects, such as walls, that may affect its operations.

Optional functionalities may include internal electronic or mechanical tamper sensors or delivery components to support the functionality destruct system (as deployed by the capsule injector 10, for example). The tamper detection system may comprise a contact switch, in the closed position, that is located between the grip 102 and the cover 11. When the cover 11 is removed, the switch contacts may release, creating an open circuit. If the system 200 has not been placed in maintenance mode by an authorized user, the system 200 may create an alert indicating that an attempt to tamper with the firearm 100 is in progress. Optional functionalities may include collection of data on information such as live fire incidents, the user in possession of the firearm 100 during such incidents, or selected environmental data and climate conditions during such incidents. The system 200 may use sensors embedded in the I/O board 3 and coupled with the system 200 through the general purpose I/O interface to collect data such as acceleration, voices, pictures, NFC connections, etc. The data may be stored in the firearm 100, such as in the onboard database 22, until the data is accessed or cleared remotely.

Activations of functionalities of the firearm 100 may be reported to one or more trusted destinations in real-time (e.g., the network server 922 or database 930) or may be retrieved via a WiFi/Cellular/Bluetooth connection to which the firearm 100 is communicatively coupled. The I/O board 3 may include a wireless communication enabled device that can communicate with the application 23 or remote device 6 wirelessly. A report menu generator may include a system that provides various reports of data through a user interface of the remote device 6 or a user interface associated with the firearm 100. Such data may include, for example, data regarding live fire incidents, history of usage of the firearm 100 by authorized user name, or history of usage of the firearm 100 by RFID tag 13 identifications.

In an embodiment of the invention, the firearm 100 may include a voice biometric override system. For example, in emergency conditions, such as if the user has lost control of the firearm 100, the authorized user may send voice commands to the firearm 100 directly or through the remote device 6 (thereby bypassing the command input of firearm 100) to override a default mode or other functionality. The commands may be linked solely to the authorized user's voice such that only the authorized user's voice will allow for control of the firearm 100. Thus, built-in controls may be subordinate to and overridden by such voice commands (or text commands) by the authorized user. One or more of the applications 2, 23 of system 200 in the firearm 100 and the remote device 6 may utilize voice biometrics for this purpose and authenticate that the user who is verbalizing the instruction is indeed the authorized user of the firearm 100. If the system 200 authenticates the user's voice as the authorized user, then the system 200 may execute the command that was verbally communicated. The verbal instructions, among other things, may be used to change the state, or mode, of the firearm 100. In embodiments including the voice biometric override system, the user may verbally communicate instructions that will override any existing state directly to the firearm 100 or through the remote device 6.

The voice biometric capability, when enabled, may provide an alternative to authorization using one or more tags, and may be configured to override all (i.e., be treated as superior to) other forms of input so that the firearm 100 carries out the user's verbal command regardless of the current status of the firearm 100. To this end, the processor 1 may receive verbal commands through an internal microphone. Voice biometric software being executed by the processor 1 may confirm the authenticity of the user's voice and implement the command. If a verbal confirmation of the command from the firearm 100 is desired, the user may activate this feature, e.g., by selecting a box in a voice biometric feature activation window. The voice commands may also be received by the remote device 6, the authenticity of the user's voice confirmed by biometric software being executed by processor 19, and the command transmitted to the processor 1 of firearm 100 by the remote device 6, e.g., as a text message.

Advantageously, the above described voice override feature may allow an authorized user who is struggling for control of the firearm 100 with an assailant to disable the firearm 100, e.g., by verbally commanding the firearm 100 to enter the Forced Disable mode. Once in the Forced Disable mode, the user may be able to shift their focus from controlling the firearm 100 to escaping from or subduing the assailant with the knowledge that the firearm 100 cannot be fired by the assailant.

Optional functionalities may include a sleep mode such that when activity of the firearm 100 ceases for a predetermined period of time, the firearm 100 activates a low-power mode to reduce battery consumption to a minimum. While in sleep mode, the system 200 may wake quickly and return to a higher powered mode when the firearm 100 is activated via remote control as described herein or via some type of physical action, such as movement or disconnection from a charger or a holster. In addition, the general purpose I/O interface and the active BLE system may be stopped while the system 200 is in sleep mode. Optional functionalities may include a user definable menu to allow the firearm 100 to be programmed for one or more modes of operation, such as wherein the firearm 100 detects and responds to non-routine activities during routine activities so each mode may identify one or more potential problems and react accordingly (such as by alerting an authorized user of the detected problem).

For example, the user may selectively activate the Forced Enable or Forced Disable mode, which places the firearm 100 into either an unlocked or locked state, respectively. This locked or unlocked state may persist until the user activates another mode, or may persist for a predetermined duration after which the firearm 100 changes to another mode, e.g., returns to the previous mode or changes to the Ready mode. The user may select whether activating the Forced Enable or Forced Disable mode causes the system 200 to immediately place the firearm 100 in the unlocked/locked state, or causes the system 200 to activate the selected state after a predetermined amount of time or in response to an event, such as the firearm 100 entering a low battery sleep mode. Placing the firearm 100 into the Forced Enable mode immediately may allow the user to permit use of the firearm 100 by another person who does not have an authorized RFID tag 13, e.g., by a family member while the user is away, or by another officer in a law enforcement environment.

The user may also configure the system 200 to enter the Forced Enable or Forced Disable mode in response to selected events so that the firearm 100 is placed in either a locked or unlocked state by default under certain conditions. For example, the user may set the system 200 to switch from a currently active mode (e.g., the Ready mode) to either the Forced Enable or Forced Disable mode in response to a state of charge of the internal battery dropping below a predetermined level indicative of a low battery condition, or "discharged battery threshold". The user may further set the system 200 to switch back to the previously active mode (or some other predetermined mode such as the Home, Away, or Ready modes) from the Forced Enable/Forced Disable mode in response to the state of charge of the internal battery rising above another level indicative of a charged condition, or "charged battery threshold".

The charged battery threshold may correspond to a state of charge equal to or higher than the discharged battery threshold. The state of charge may be determined by comparing an output voltage of the internal battery to a known discharge curve, by measuring a current provided by the internal battery, or using any other suitable method. In an embodiment of the invention, the charged battery threshold may be associated with a state of charge sufficiently higher than the discharged battery threshold to provide a hysteresis that prevents the system 200 from making unwanted rapid changes between modes of operation. For example, the charged battery threshold may be associated with a state of charge ≥70% and the discharged battery threshold may correspond to a state of charge ≤10%. The state of charge thresholds may also be set by the user based on their personal preferences.

Selection of which mode the system 200 enters when the battery is low may be made by the user based on the operating environment of the firearm 100. In a law enforcement environment, the user may prefer the firearm 100 be enabled if the battery goes dead while on patrol. In contrast, a user who typically leaves the firearm 100 at home may prefer the system 200 disable the firearm 100 if the battery goes dead while they are away. Advantageously, embodiments of the invention allow the user to select how the system 200 responds to events, such as a low battery, thereby maximizing the utility of the system 200 to each user.

By way of example, when the application 2 of firearm 100 detects a low battery condition, the application 2 may cause the processor 1 to transmit a message to the remote device 6 informing the user of the impending exhaustion of the main power supply 8. In response to receiving the message, the remote device 6 may display an onscreen notification that provides suggestions to the user, such as connect the auxiliary battery 17. The onscreen notification may also display buttons that provide menu driven options such as activate the Forced Enable mode (thereby placing the firearm 100 in a constantly enabled state regardless of battery life and assuring that the user will not be without a usable firearm 100), or activate the Forced Disable mode (thereby placing the firearm 100 in a constantly disabled state regardless of battery condition). The Forced Enable mode may be implemented by the user, for example, if the user is currently carrying the firearm 100 (e.g., is on patrol) and does not have access to an auxiliary battery 17.

It should now be understood that the embodiments described herein are directed toward the system 200 of a firearm 100 that allows for systems and methods of use to monitor or control functionalities of the firearm 100. For example, the system 200 permits enabling and disabling of the firing functionality of the firearm 100, communication to and from the firearm 100 via one or more alerts, messages, or actions, remote control administration and complete deactivation of the firearm 100, voice biometric security associated with the firearm 100, and additional secondary functionality options through a menu-driven user interface associated with the firearm 100.

The system 200 may identify persons authorized to use, service, or control the firearm 100, may make such functionalities of the firearm 100 accessible to such authorized users, and may permit an authorized user to render the firearm 100 permanently dysfunctional, such as where the firearm 100 is lost or an unauthorized attempt is reported to have been made to gain access to the secure area protected by the cover 11 of firearm 100. The integrated technology driven safety system as implemented and operational through the system 200 may thereby mitigate many risks associated with unauthorized usage or misuse of firearms.

It should be understood that embodiments of the invention do not require all of the components depicted in FIGS. 1 and 2. For example, embodiments of the invention may omit one or more of the processor 1, application 2, I/O board 3, locking device 4, reading device 5, remote device 6, secondary identification device 7, main power supply 8, LED 9, capsule injector 10, cover 11, communication port 12, RFID tag 13, maintenance latching device 14, power switch 15, tamper detection switch 16, auxiliary battery 17, inventory control tag 18, processor 19, memory 20, memory 21, database 22, application 23, charging device 24, or electronic tag 25.

Figure 3:
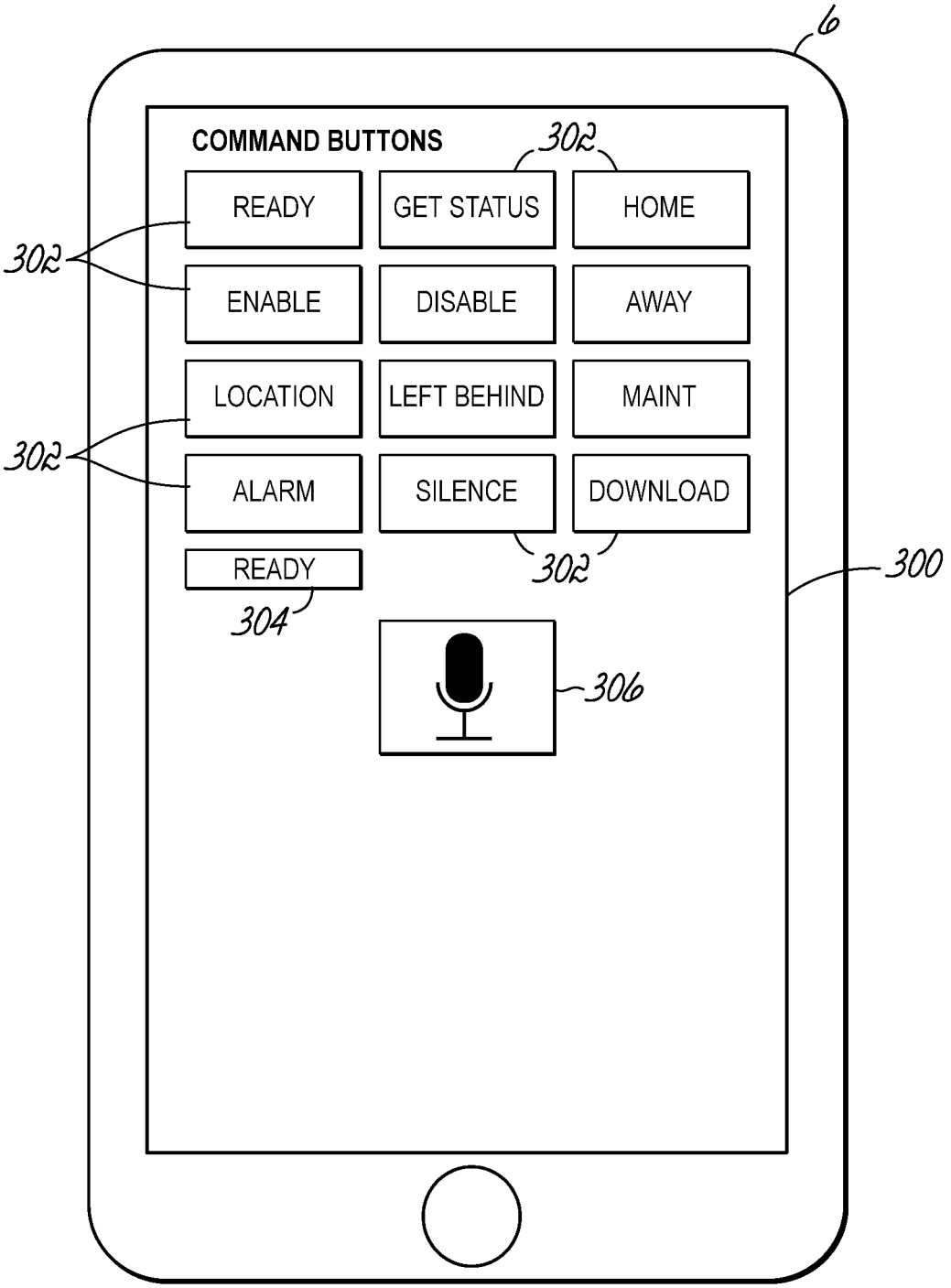
FIG. 3 is a diagrammatic view of a user interface that may be displayed by the remote device of FIG. 2.

FIG. 3 depicts an exemplary user interface 300 that may be displayed by the remote device 6. The user interface 300 may be a graphical user interface configured to display information to and receive input from the user. The user interface 300 may include a plurality of command buttons 302. In response to being activated by the user, each command button 302 may cause the system 200 to perform a task specific to that button, such as changing the mode of the system 200. Exemplary command buttons include a "Ready" button that causes the system 200 to enter the Ready mode, a "Get Status" button that causes the remote device 6 to display the current status (e.g., mode) of the system 200, a "Home" button that causes the system 200 to enter the Home mode, an "Enable" button that causes the system 200 to enter the Forced Enable mode, a "Disable" button that causes the system 200 to enter the Forced Disable mode, an "Away" button that causes the system 200 to enter the away mode, a "Location" button that causes the system 200 to enter a location tracking mode or causes the remote device 6 to display the location of the firearm 100, a "Left Behind" button that causes the system 200 to enter the Left Behind mode, a "Maintenance" button that causes the system 200 to enter the Maintenance Mode, an "Alarm" button that causes the firearm 100 to emit an alarm (e.g., a loud distinctive sound), a "Silence" button that silences the remote device 6 or firearm 100, and a "Download" button that downloads information regarding use of the firearm 100 to the remote device 6. The user interface 300 may also include a status indictor 304 that displays the current mode of the system 200 (e.g., "READY"), and button 306 that activates the voice control feature.

Figure 4:
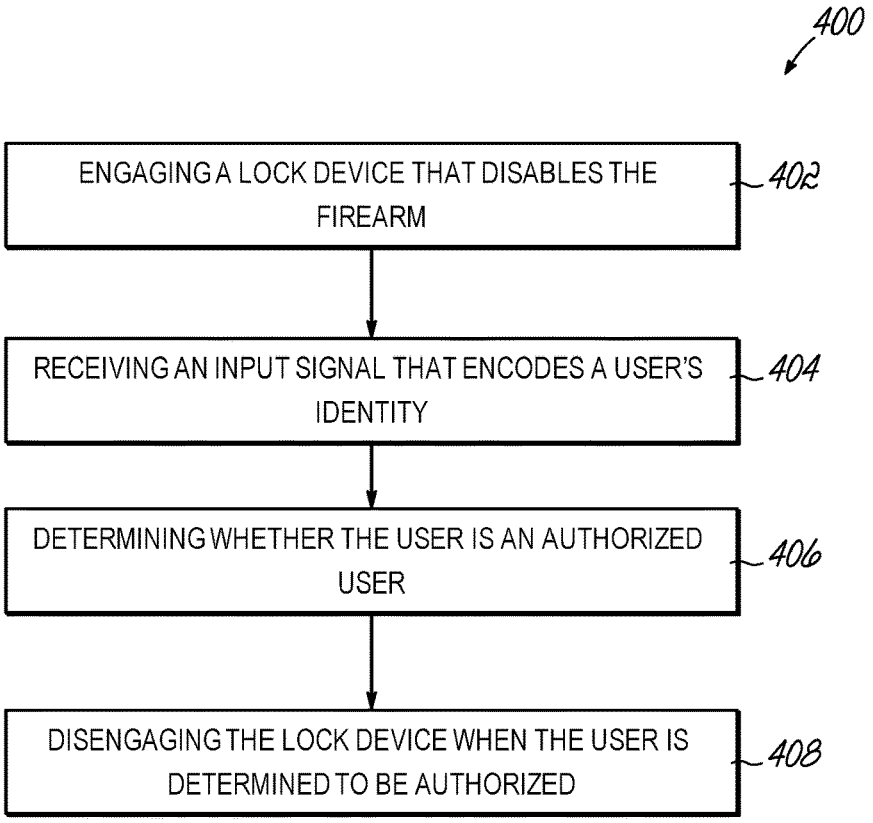
FIG. 4 is a flow chart depicting a processor based method of controlling a firearm comprising the smart technology system of FIG. 2.

FIG. 4 depicts a flow chart illustrating a processor based method, or process 400, that may be used to control the firearm 100 using the smart technology system 200. In stage 402 of process 400, the processor 1 may engage the locking device 4 that disables mechanical components of the firearm 100 which are required to discharge the firearm 100. In stage 404 of process 400, the processor 1 may receive an input signal from the I/O interface, e.g., the I/O board 3. The input signal may encode information regarding the identity of a user attempting to use the firearm 100. In stage 406 of process 400, the processor 1 may determine, from the input signal, whether the user is an authorized user. In stage 408 of process 400, when the user is determined to be an authorized user, the processor 1 may disengage the locking device 4 to enable the mechanical components of the firearm 100 that are required to discharge the firearm 100.

Figure 5A:
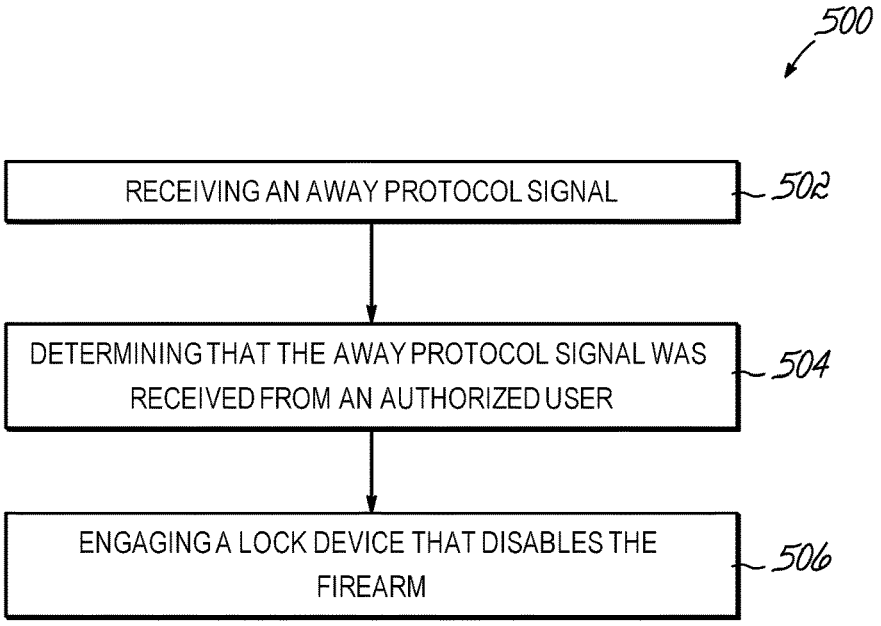
FIG. 5A is a flow chart illustrating an "away protocol" for controlling a firearm comprising the smart technology system of FIG. 2.

FIG. 5A depicts a flow chart illustrating an "away protocol" process 500 that may be used to control the firearm 100 using the smart technology system 200. The away protocol process 500 may provide functionality for an authorized user to place the firearm 100 in a disabled state for an extended period of time. For example, an authorized user may wish to leave the firearm 100 at home and have the firearm 100 disabled so that no one else in the house can use the firearm 100 during the time of the authorized user's absence. An authorized user may issue a command that initiates the "away protocol" using an external device, e.g., the remote device 6. For example, a user may issue the command using a smart cellular telephone or other external device. The away protocol command may be issued by an authorized user who enters a voice-based or text-based command to the external device. The external device may then generate a signal that is communicated to the firearm 100.

At stage 502 of process 500, the firearm 100 may receive a signal from the external device indicating that the away protocol has been issued. The signal may be received by the firearm 100 through a wired or wireless connection. In stage 504 of process 500, the processor 1 may determine that the away protocol was received from an authorized user. Upon determining that the away protocol signal was received from an authorized user, in stage 506 of process 500, the processor 1 may engage the locking device 4 that disables the firearm 100. In a further embodiment, the away protocol may be issued directly to the firearm 100 using a voice command that is received by a biometric device. The biometric device may be configured to perform voice recognition to determine that an away protocol command has been received from an authorized user. The biometric device may then generate the away protocol signal in response to receiving the voice command from the authorized user. As described above, the application 23 that runs in the remote device 6 as well as the application 2 that runs in the firearm 100 may both have the capability to receive and act on voice instructions verbalized by an authorized user. The portions of the system 200 in the firearm 100 and the remote device 6 may each utilize voice biometrics for this purpose and authenticate that the user who is verbalizing the instruction is indeed an authorized user of the firearm 100. If the portion of the system 200 in the firearm 100 or the remote device 6 authenticates the received voice as that of an authorized user, then the system 200 may execute the command that was verbally communicated.

Figure 5B:
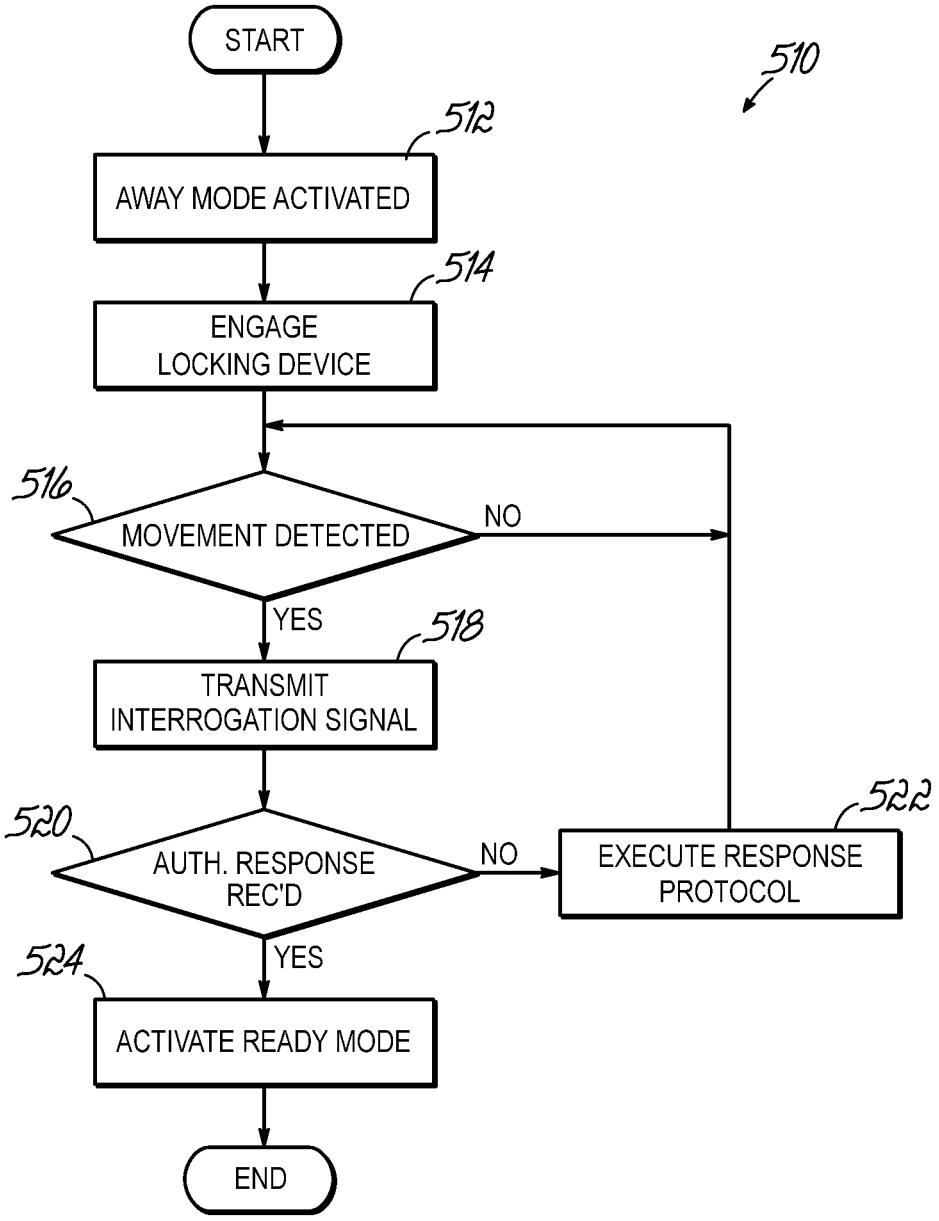
FIG. 5B is a flow chart depicting a process that may be executed by the smart technology system of FIG. 2 while the firearm is in an away mode.

FIG. 5B depicts a flowchart illustrating a process 510 that may be executed by the system 200 (e.g., the processor 1 of firearm 100) while the system 200 is in the Away mode. In block 512, the Away mode is activated, e.g., by the application 2 receiving an activate Away mode command from an authorized remote device, such as remote device 6. In response to the Away mode being activated, the process 510 may proceed to block 514, engage the locking device 4 so that the firearm 100 will not fire, and proceed to block 516. If the locking device 4 is already engaged when the Away mode is activated, the process 510 may proceed directly from block 512 to block 516. The locking device 4 may already be engaged, for example, if the firearm 100 is in the Ready mode and the RFID tag 13 is not proximate to the firearm 100. The state of the locking device 4 may be determined, for example, by setting or clearing a flag each time the locking device 4 is engaged or disengaged, or using a sensor (not shown) that indicates the state of the locking device 4.

In block 516, the process 510 may determine if the firearm 100 has been moved. Movement may be detected, for example, by monitoring signals from the motion detection device or using GPS, a wireless network based positioning system, or any other suitable method. If the process 510 does not detect movement ("NO" branch of decision block 516), the process 510 may continue to monitor the firearm 100 for movement. If the process 510 detects movement ("YES" branch of decision block 516) the process may proceed to block 518.

In block 518, the process 510 may transmit an interrogation signal, such as a radio frequency signal configured to elicit a response from an RFID tag associated with an authorized user, e.g., RFID tag 13. If an authorized response to the interrogation signal is not received ("NO" branch of decision block 520), the process 510 may proceed to block 522 and execute a predetermined response protocol. The response protocol may be a default protocol associated with the Away mode, or may be a protocol defined by the user for responding to unauthorized movement of the firearm 100 while in the Away mode.

By way of example, the response protocol may include the processor 1 transmitting a signal (e.g., a text message or initiating a phone call) to the remote device 6, thereby alerting the user that the firearm 100 has been moved. The user may then decide how to respond to the alert, e.g., by doing nothing, or by using the remote device 6 to cause the firearm 100 to emit an alarm, determine a location of the firearm 100, or download an image or video feed from one or more of the rearward facing camera 116 or forward facing camera 118. In an embodiment of the invention, the signal may establish a video or audio link between the remote device 6 and firearm 100 so that the user can see the images or video feed or communicate with person moving the firearm 100, e.g., issuing a warning to put the firearm 100 down. The user may also instruct the system 200 to record images, video, or audio in the network database 930, e.g., for later use as evidence of attempted unauthorized use or theft of the firearm 100. The user may also define the response protocol to automatically cause the firearm 100 to emit an alarm or warning signal (e.g., a voice command to put down the firearm 100), determine its location, capture images/video, or upload location data or images/video to the network database 930.

If the authorized response to the interrogation signal is received ("YES" branch of decision block 520), the process 510 may proceed to block 524 and activate the Ready mode so that the firearm 100 is ready to function when in the presence of the RFID tag 13.

Figure 6:
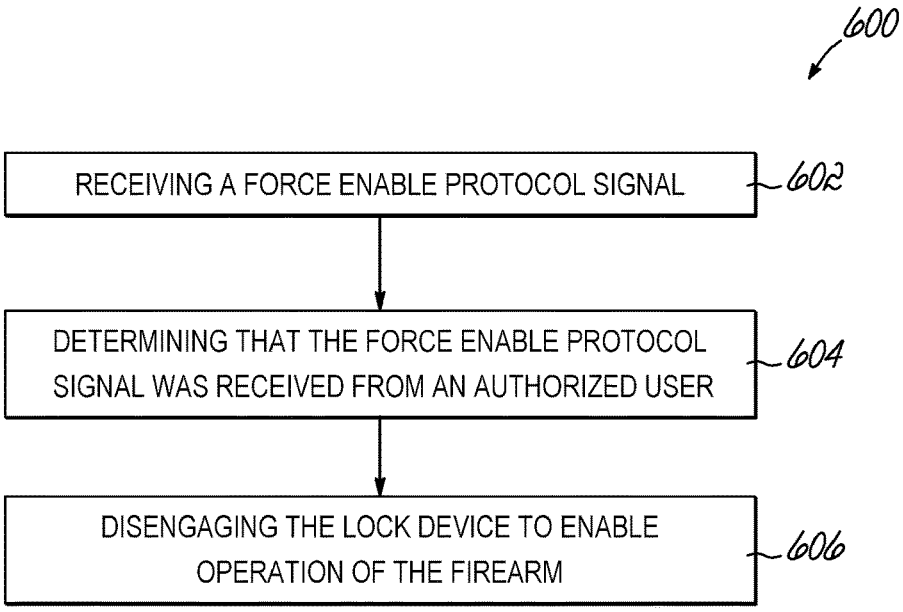
FIG. 6 is a flow chart illustrating a "forced enable protocol" for controlling a firearm comprising the smart technology system of FIG. 2.

FIG. 6 depicts a flow chart illustrating a "forced enable protocol" process 600 for controlling the firearm 100 using the smart technology system 200. In a sense, the forced enable protocol may be thought of as the opposite of the away protocol. In this regard, when the forced enable protocol is issued, the firearm 100 may be placed in an enabled state. As with the away protocol, the forced enable protocol may be initiated by a voice or text command issued by an authorized user. For example, the forced enable protocol command may be issued by an authorized user who enters a voice-based or text-based command to an external device. In a further embodiment, the forced enable protocol may be initiated when an authorized user issues the forced enable protocol directly to the firearm 100 using a voice command that is received by the biometric performing voice recognition to determine that a forced enable protocol command has been received from an authorized user.

At stage 602 of process 600, the firearm 100 may receive a signal from the remote device 6 indicating that the forced enable protocol has been issued. The signal may be received by the firearm 100 through a wired or wireless connection. In stage 604 of process 600, the processor 1 may determine that the forced enable protocol was received from an authorized user. By way of example, this determination may be made based on a unique identity of the remote device 6 matching that of an authorized user, a code contained in the message received from the remote device (e.g., a user password), or biometric confirmation of the voice issuing the command. Upon determining that the forced enable protocol signal was received from an authorized user, in stage 606 of process 600, the processor 1 may disengage the locking device 4 to enable operation of the firearm 100. In a further embodiment, the forced enable protocol may be issued directly to the firearm 100 using a voice command that is received by a biometric device which is configured to perform voice recognition to determine that a forced enable protocol command has been received from an authorized user. The biometric device may then generate the forced enable protocol signal in response to receiving the voice command from the authorized user. The Forced Enable mode may be active until cancelled by the authorized user, or may be active for a predetermined amount of time after which the firearm 100 enters another mode, e.g., the previously active mode.

According to further embodiments, other protocols may be provided. For example, a "ready protocol" may provide functionality to allow an authorized user to place the firearm 100 in the Ready mode. In this regard, while in the Ready mode, the firearm 100 may only be operated when an RFID signal is received indicating the proximity of an authorized user.

Figure 7:
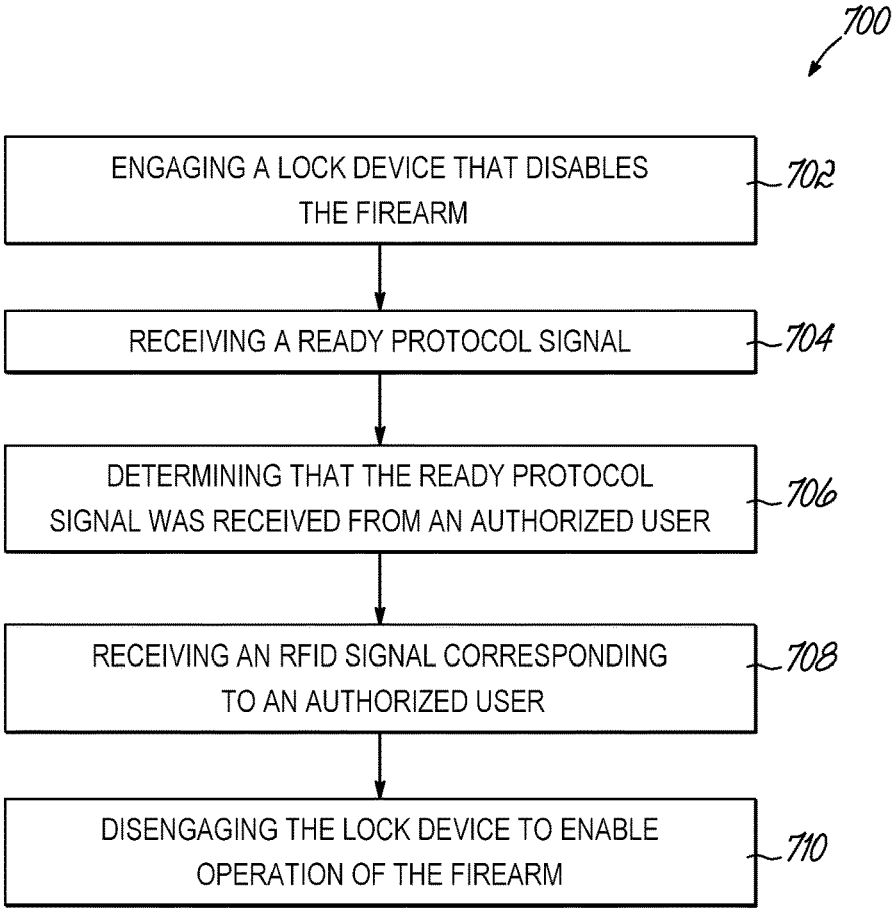
FIG. 7 is a flow chart illustrating a "ready protocol" for controlling a firearm comprising the smart technology system of FIG. 2.

FIG. 7 depicts a flow chart illustrating a "ready protocol" process 700 for controlling the firearm 100 using the smart technology system 200. In stage 702 of process 700, the process 700 engages the locking device 4 that disables the mechanical components of the firearm 100 which are required to discharge the firearm 100. This locked state may be a default state in which the firearm 100 is maintained by the ready protocol. In stage 704 of process 700, the process 700 receives an input signal from an I/O device, the signal encoding a ready protocol signal. In stage 706 of process 700, the process 700 determines from the input signal that the user is an authorized user. In stage 708 of process 700, the process 700 receives an RFID signal and determines the RFID signal is associated with an authorized user. In stage 710 of process 700, when the user is determined to be an authorized user, the process 700 disengages the locking device 4 to enable the mechanical components of the firearm 100 that are required to discharge the firearm 100.

According to a further embodiment, a "forced disable protocol" may be provided. In this regard, the "forced disable protocol" is similar to the "away protocol," described above and illustrated in FIG. 5A, with the additional feature that, when in the forced disable mode, the firearm 100 is not enabled by the presence of an RFID tag 13 from an authorized user.

Figure 8:
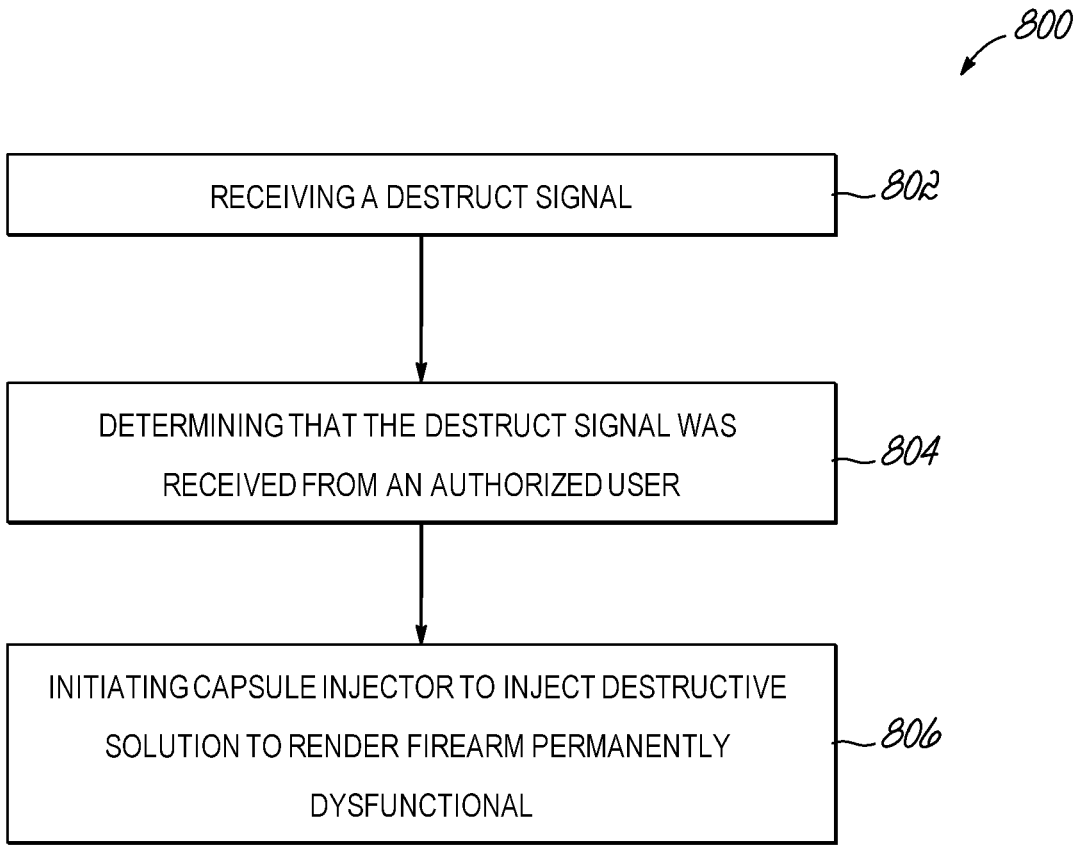
FIG. 8 is a flow chart illustrating a "destruct protocol" for controlling a firearm comprising the smart technology system of FIG. 2.

FIG. 8 depicts a flow chart illustrating a "destruct protocol" process 800 for controlling the firearm 100 comprising the smart technology system 200. The destruct protocol may provide a capability to render the firearm 100 permanently dysfunctional in response to an authorized user issuing a destruct command or signal. The functionality provided by the destruct protocol may be advantageous in the event that the firearm 100 becomes lost or stolen. In this regard, an authorized user may issue the destruct signal using voice or text-based command to the remote device 6. The destruct protocol may be initiated when an authorized user issues the destruct command directly to the firearm 100 using a voice command that is received by the biometric device that performs voice recognition to determine that a destruct command has been received from an authorized user.

At stage 802 of process 800, the firearm 100 may receive a destruct signal from an external device (e.g., the remote device 6) indicating that the destruct command has been issued. The signal may be received by the firearm 100 through a wired or wireless connection. In stage 804 of process 800, the processor 1 may determine that the destruct signal was received from an authorized user. Upon determining that the destruct signal was received from an authorized user, in stage 806 of process 800, the processor 1 may activate the capsule injector 10 to release a destructive solution rendering the firearm 100 permanently dysfunctional. In a further embodiment, the destruct command may be issued directly to the firearm 100 using a voice command that is received by a biometric device that performs voice recognition to determine that a destruct command has been received from an authorized user. The biometric device may then generate the destruct signal in response to receiving the voice command from the authorized user.

The destructive solution may include a two-part epoxy or other similar agent contained in a gel-capsule that, upon release, is capable of producing irreparable damage to one or more mechanical components of the firearm 100. The destructive solution may, for example, employ an agent capable of permanently freezing the hammer 110 or other component of the firing mechanism of firearm 100 such that the firearm 100 is rendered incapable of firing.

Figure 9:
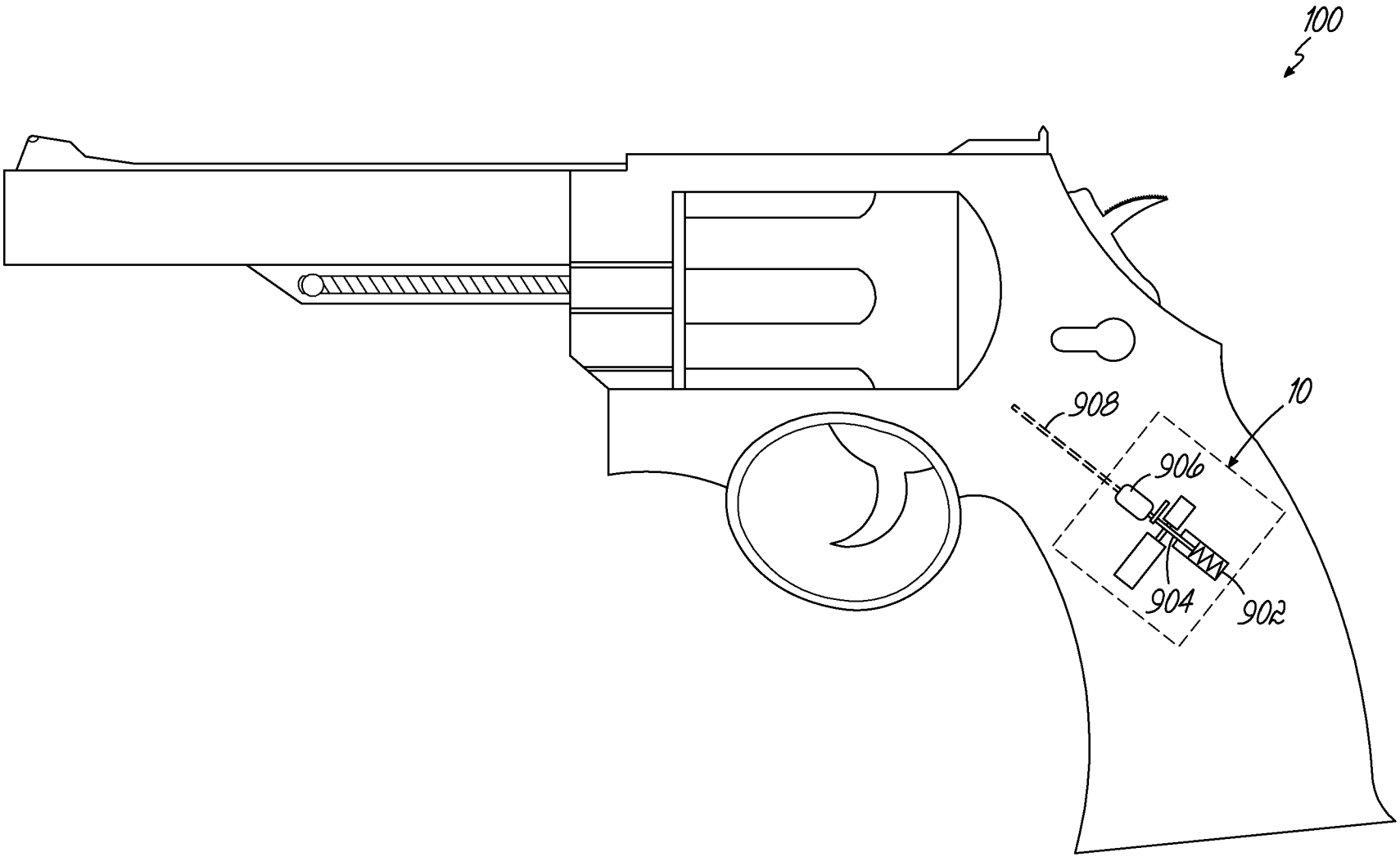
FIG. 9 is a schematic illustration of a capsule injector that may be included in the firearm of FIG. 1.

FIG. 9 is a schematic illustration of the firearm 100 showing the capsule injector 10 according to an embodiment of the invention. The capsule injector 10 may be a mechanism that comprises a solenoid 902 that, when activated by a command from the authorized user, pushes a pin 904 to permeate the gel-capsule 906 containing the destructive solution, releasing the destructive solution into a channel 908 and rendering the firearm 100 inoperable. The capsule injector mechanism may be connected to the rest of the system 200 via the I/O board 3.

Figure 10:
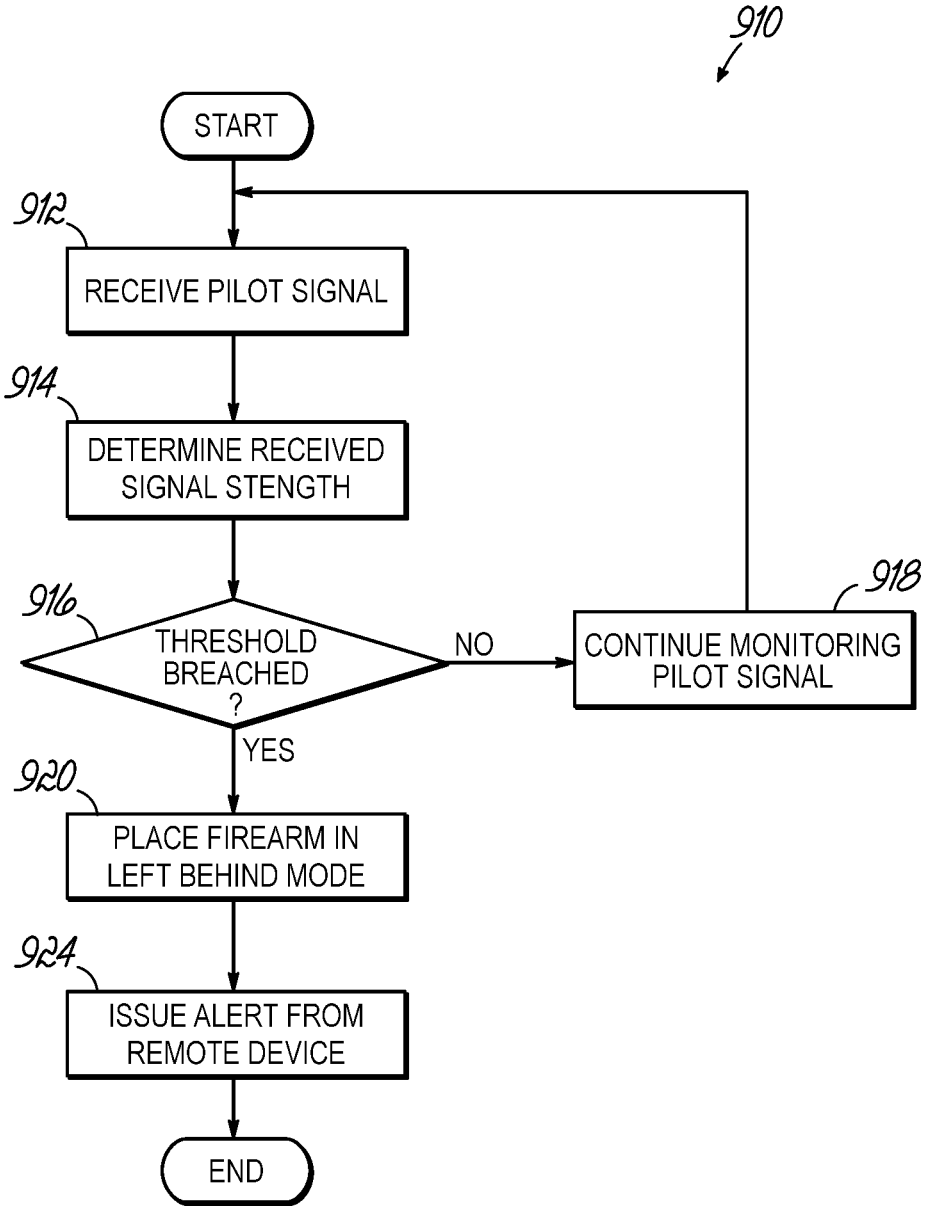
FIG. 10 is a flowchart of a process that may be executed by the smart technology system of FIG. 2 for placing the firearm into a left behind mode.

FIG. 10 depicts a flowchart illustrating a process 910 that may be performed by the system 200 to provide a "left behind" feature. The left behind feature may be active when the system 200 is in the Ready mode (e.g., by running process 910 in the background), or may be selectively activated by the user to be active or inactive in one or more modes. In block 912, the process 910 may receive a pilot signal. The pilot signal may be a wireless signal such as a pilot subcarrier of a WiFi signal, a Bluetooth beacon signal, or any other suitable signal, e.g., a signal having a known transmit power level. In an embodiment of the invention, the pilot signal may be emitted by the remote device 6 and received by the processor 1 of firearm 100, e.g., via the I/O board 3.

In response to receiving the pilot signal, the process 910 may proceed to block 914 and determine the strength of the received signal. The signal strength may be indicative of a distance between the device transmitting the pilot signal (e.g., the remote device 6) and the device receiving the signal (e.g., the processor 1). For example, a WiFi signal may provide a continuous pilot signal the inherently degrades with distance. This signal strength may be measured, and a number of menu-driven, predetermined or preselected actions taken at predetermined signal strength levels.

In block 916, the process 910 may determine if the signal strength of the received signal has breached (e.g., dropped below) a predetermined threshold level. The threshold level may be set to coincide with a distance d indicative of the firearm 100 being separated from the user. For example, the threshold may correspond to a distance d≥5 feet, which may correspond to a signal level of −65 dBm or a Received Signal Strength Indicator (RSSI) of 70%. By way of example, the RSSI may be determined from the signal level as follows:

$$\text{RSSI}=A\times(S+B) \qquad \text{Eqn. 1}$$

where A is a scaling factor (e.g., A=2), B is an offset factor (e.g., B=100), S is the signal level in dBm, and the value of RSSI is limited to a minimum of 0 and a maximum of 100. The received signal strength may also be compared to a transmitted signal strength, which may be determined based on data embedded in the pilot signal indicative of the transmit power of the transmitting device.

In response to the threshold level not being breached ("NO" branch of decision block 916), the process 910 may proceed to block 918 and continue monitoring the pilot signal. In response to the threshold level being breached ("YES" branch of decision block 916), the process 910 may proceed to block 920.

In block 920, the process 910 may cause the system 200 to enter the Left Behind mode. In response to entering the Left Behind mode, the application 2 may transmit a message to the remote device 6 as described below. The application 2 may also activate one or more of the locking device 4 (if not already in the locked state, e.g., due to the absence of the RFID tag 13 while in the Ready mode), capsule injector 10, or latching device 14. This activation may be automatic based on user settings stored in memory 21, or in response to receiving a message from an authorized external device such as remote device 6. The process 901 may also cause the application 2 to activate one or more location-based features, such as by activating an internal GPS receiver, a wireless network based location tracking system, or a location-based service that transmits the location of the firearm 100 to the network server 922.

In response to, or concurrently with entering the Left Behind mode, the process 910 may proceed to block 924 and cause the remote device 6 to issue one or more alerts of varying type depending on the signal strength of the received signal. Causing the remote device 6 to issue an alert may include the application 2 transmitting a text message, phone call, or other communication signal to the remote device 6. The communication signal may be delivered to the remote device 6 directly or via a network, such a mobile network, a local wireless network, or the Internet. The communication signal may be transmitted using a mobile phone communication protocol, Wi-Fi, Bluetooth, or any other suitable communication protocol. The message may include information indicative of the signal strength of the pilot signal so that the application 23 running on remote device 6 can determine what type of alert to generate.

By way of example, for a signal that is at a relatively high level below the threshold (e.g., a signal level of between −65 and −75 dBm, or an RSSI between 70% and 50%), the remote device 6 may emit a relatively low level alarm (e.g., a chirp). If the signal is at a medium level below the threshold (e.g., a signal level of between −75 and −90 dBm, or an RSSI between 50% and 20%), the remote device 6 may emit a medium level alarm (e.g., a vibration). If the signal is at a low level below the threshold (e.g., a signal level of between −90 and −100 dBm, or an RSSI between 20% and 0%), the remote device 6 may emit a high level alarm (e.g., a ring tone in response to receiving a call from the application 2). Advantageously, providing alarms having a sequentially more urgent characteristic (e.g., a sound, vibration, or light emission having an amplitude, tone, and or color) as the distance between the remote device 6 and firearm 100 increases may provide the user with useful information. For example, if during the retrieval process the chirping sound is followed by an alarm having a different characteristic (e.g., a another sound, a vibration, or a ring tone), it could indicate that the firearm 100 is moving away from the user and possibly in the hands of someone who intends to steal the firearm 100.

The process 910 may monitor the pilot signal in an essentially continuous manner. This may provide an advantage over using a "heartbeat" method in which the remote device 6 and firearm 100 periodically exchange signals in order to verify the distance between the firearm 100 and the user has not exceeded a predetermined distance.

In an alternative embodiment of the invention, the pilot signal may be transmitted from the firearm 100 (e.g., by the processor 1 or I/O board 3) and received by the remote device 6. In this embodiment, the application 23 running on remote device 6 may determine the received signal strength and whether the threshold has been breached. If the threshold has been breached, the application 23 may cause the remote device 6 to issue the appropriate alert based on the relative strength of the pilot signal (e.g., low, medium, or high), and transmit a communication signal to the firearm 100 instructing the application 2 to enter the left behind mode.

In any case, in response to receiving the alert from the remote device 6, the user may return to the last known location of the firearm 100, e.g., firing range, skeet field, vehicle, restroom, etc. If the firearm 100 is not found in the last known location, the user may activate one or more features using the remote device 6. These features may include location tracking, high decibel output, and the destruct feature.

Referring now to FIG. 11, an operating environment 926 for the location tracking feature may include the remote device 6, the firearm 100, the network server 922, and a user system 928 that are in communication over a network 931. The network 931 may include one or more private or public networks (e.g., the Internet, Local Access Networks (LANs), Wi-Fi hotspots, cellular carriers, etc.) that enable the exchange of data between the remote device 6, the firearm 100, the network server 922, and the user system 928. The user system 928 may be a desktop computer, laptop computer, tablet computer, smart phone, or any other computing device that enables the user to communicate with the firearm 100 or network server 922.

The network server 922 may include a database management system that manages the network database 930. The network database 930 may store location data, image data, operational data, or any other data transmitted from the firearm 100 and received by the network server 922. The network server 922 may also include a web server or other applications that enable the remote device 6 or user system 928 to determine the location of the firearm 100 based on data in the network database 930. As described above, the firearm 100 may periodically determine its location and transmit the location to the network server 922, e.g., in response to entering the left behind mode, in response to the user activating the location tracking feature, or in response to any other condition selected by the user. The firearm 100 may determine its position using GPS, some other satellite-based navigation system, or a wireless network based positioning system. Exemplary methods and systems for determining a position using a wireless network are disclosed by U.S. Pat. No. 8,700,060, the disclosure of which is incorporated by reference herein in its entirety.

If the initial alert (e.g., chirping) is responded to immediately, chances may be good that the firearm 100 will still be in the location where it was left, and retrieval should be inconsequential. In the unfortunate event that the firearm 100 is not where the user believes they left it, the system 200 may provide additional features to help the user recover or otherwise gain control the firearm 100. These features may include location tracking, alarming, and the Destruct mode.

In response to determining the firearm 100 has been left behind, the screen of the remote device 6 may change colors (e.g., have a red cast), the status indicator may display "LEFT BEHIND", and the user interface 300 may display or highlight buttons for activating recovery or control features, such as the Location button, the Alarm button, and a Destruct button. Certain buttons, such as the Destruct button, may be hidden while other modes are active to prevent inadvertent activation when the system 200 is not in the Left Behind mode, but may be displayed by the user interface 300 in response to the system 200 entering the Left Behind mode. Features which may cause irreversible changes to the firearm 100 (e.g., the Destruct feature) may also require confirmation from the user that they are sure they want to implement the feature before the feature protocol is activated.

Figure 12:
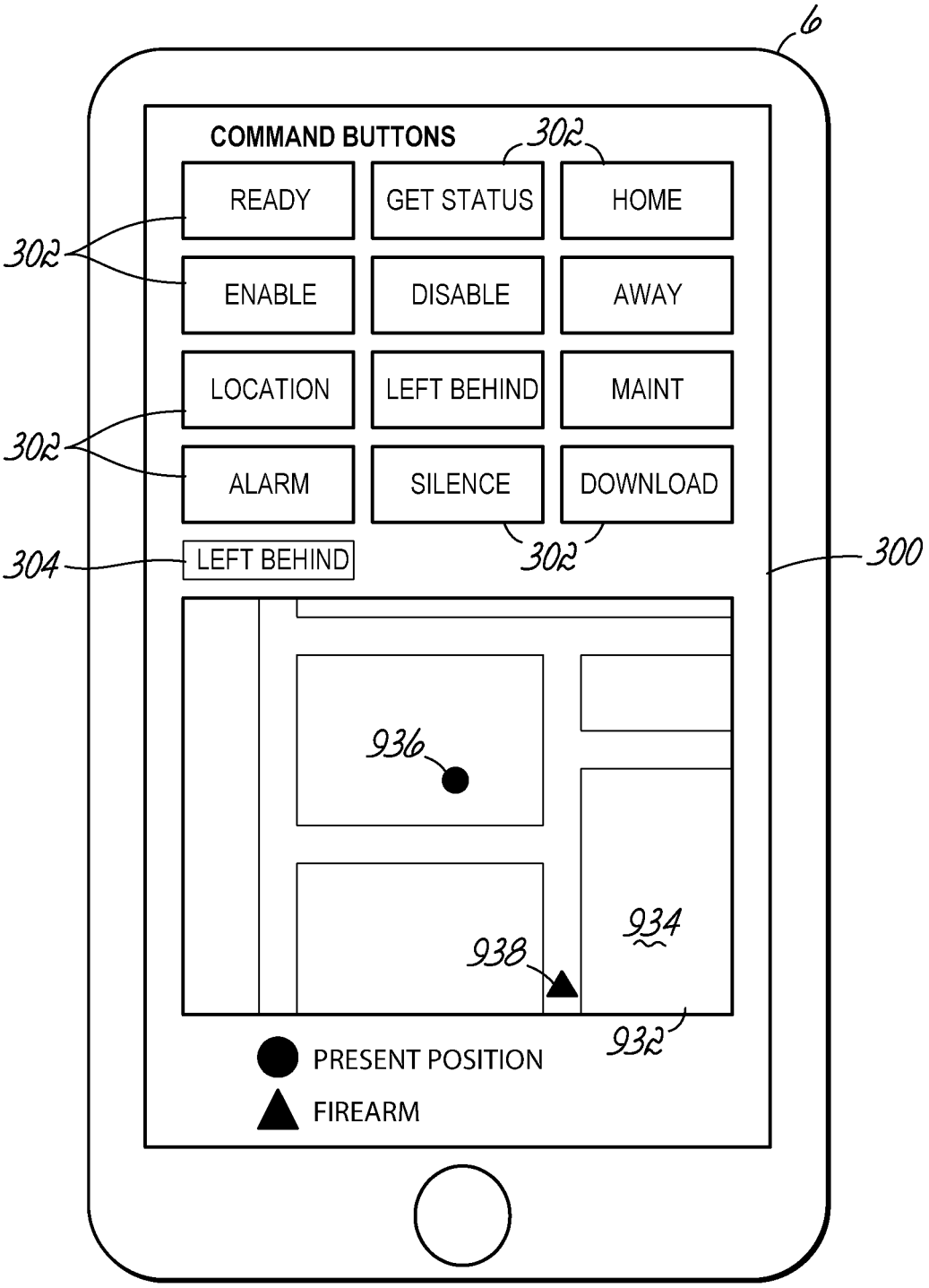
FIG. 12 is a diagrammatic view of the user interface of the smart technology system depicting a firearm tracking feature.

FIG. 12 depicts the user interface 300 including an exemplary window 932 that may be displayed by the remote device 6 in response to location tracking being active. This "onscreen" location tracking may enable the user to follow movement of the firearm 100 in the event an attempted theft is in progress. In response to activating the Location button 302 of user interface 300, the system 200 may query the network database 930 for the current or previously known locations of the firearm 100. This location information may be transmitted to the remote device 6 or user system 928 for display to the user. To this end, the window 932 may include a map 934 that displays one icon 936 indicating the present location of the remote device 6, and another icon 938 indicating the present or last known location of the firearm 100. The location of the remote device 6 may be determined by the remote device 6 using GPS or other methods described above, and the location of the firearm 100 may be based on information received from the network database 930 or the firearm 100.

The user may use the information presented by the window 932 to locate the firearm 100 and make decisions regarding what additional features the user may want to activate. For example, if the map 934 indicates that the firearm 100 is close enough such that the alarm would be audible to the user, the user may activate the Alarm button 302. Activating the alarm button 302 may cause the remote device 6 to transmit a communication signal to the firearm 100, e.g., a text message. In response to receiving the communication signal, the processor 1 of firearm 100 may cause an acoustic transducer located in the firearm 100 to produce a distinctive high intensity sound. This sound may help the user locate the firearm 100, and may also cause the person who is in possession of the firearm 100 to drop or otherwise abandon the firearm 100. As a last resort, if the firearm 100 cannot be found, the user may activate the Distruct button, thereby permanently disabling the firearm 100.

Figure 13:
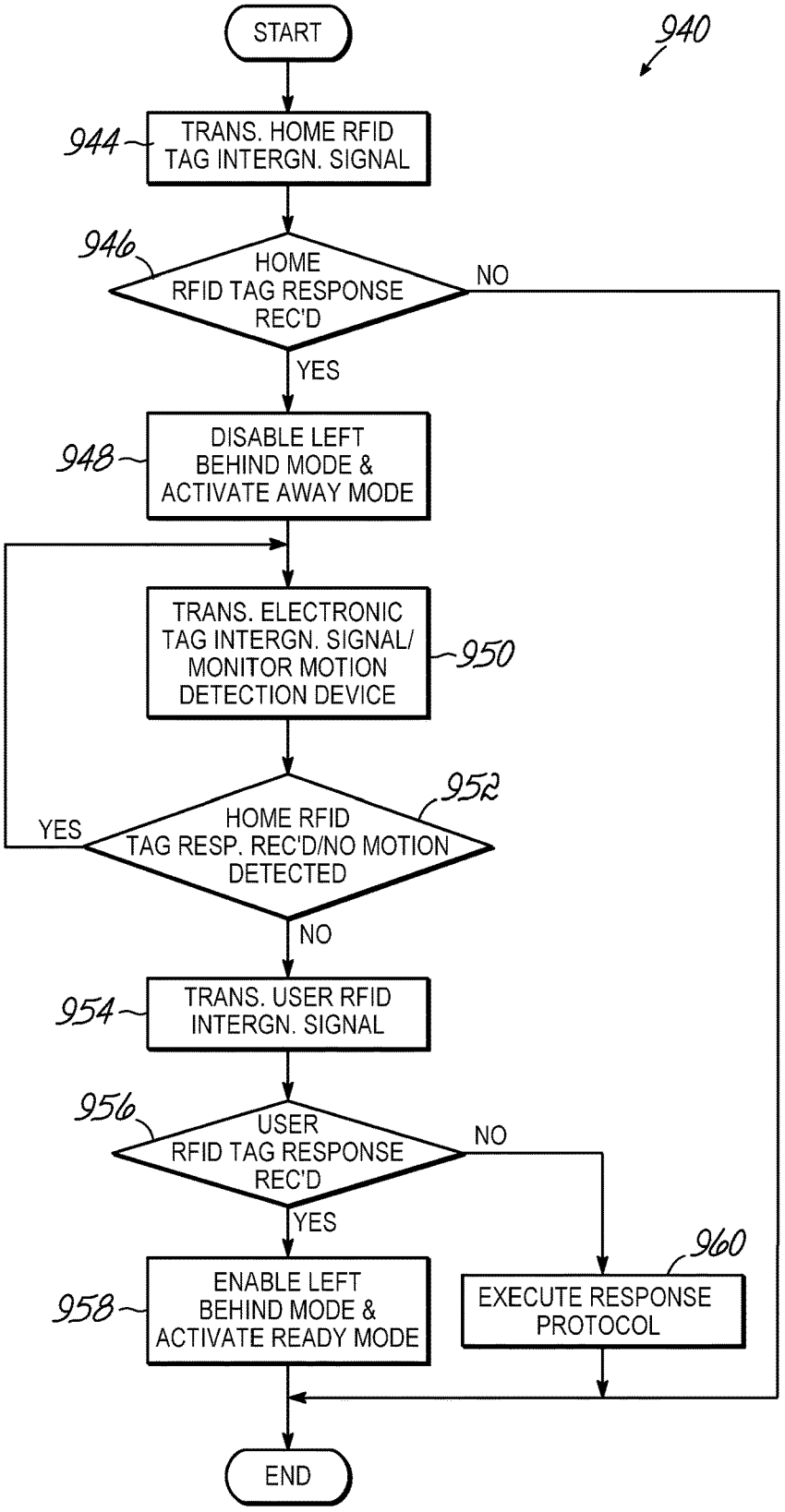
FIG. 13 is a flowchart of a process that may be executed by the smart technology system of FIG. 2 for placing the firearm into a home mode.

FIG. 13 depicts a flowchart illustrating a process 940 that may be performed by the system 200 in response to the user activating the Home mode. The Home mode may be activated by the user activating the Home button 302 (e.g., in response to leaving the firearm 100 in a safe place, such as a hotel room) or in response to the application 2 detecting that the firearm 100 has been placed in a location which has been designated as a safe place to leave the firearm 100. The application 2 may determine that the firearm 100 has been placed in a safe place, for example, by detecting the firearm 100 is located at a known location, e.g., the user's home, a police station, etc. This determination may be based on detecting the presence of an electronic tag (e.g., electronic tag 25) associated with a known safe location. For example, the electronic tag 25 may be an RFID tag embedded in a charging pad of the charging device 24 that operates at 13.56 MHz and has a unique identification that is associated with the safe place or charging device 24 in the onboard database 22. This may enable the application 2 to recognize the place or charging device 24 as a known safe place or known charging device. The electronic tag 25 may thereby enable the application 2 to recognize the firearm 100 has been coupled to the known charging device or is otherwise in a safe place where it can be left unattended for a period of time.

Referring now to block 944, the process 940 may cause the firearm 100 to transmit an electronic tag interrogation signal. This signal may be transmitted periodically or in response to an event, such as being operatively coupled to the charging device 24 or determining the distance between the firearm 100 and the remote device 6 has exceeded a threshold. If a response to the interrogation signal is not received ("NO" branch of decision block 946), the process 940 may determine that the firearm 100 has not been left in a safe place and terminate without altering the mode in which the system 200 is operating. If a response is received from the electronic tag ("YES" branch of decision block 946), the process 940 may proceed to block 948, disable the Left Behind mode, enable the Away mode, and proceed to block 950. In an alternative embodiment of the invention, the electronic tag may emit a beacon signal (e.g., a BLE beacon) that is detected by the firearm 100, thereby avoiding the need to transmit the electronic tag interrogation signal. In this embodiment, the process 940 may listen for the beacon signal rather than or in addition to transmitting the electronic tag interrogation signal.

In block 950, the process 940 may retransmit the electronic tag interrogation signal (or listen for the beacon signal) before proceeding to block 952 and determining if a response to the interrogation signal (or the beacon signal) has been received. Retransmitting the interrogation signal periodically and listening for a response signal (or listening for the beacon signal) may allow the application 2 to determine if the firearm 100 is still located in the safe place. In an alternative embodiment of the invention, the process 940 may monitor the motion detection device instead of, or in addition to, retransmitting the interrogation signal, and determine of the firearm 100 has been moved based thereon. In any case, if the appropriate signal is received, or no motion is detected ("YES" branch of decision block 952), the process 940 may return to block 950 and continue monitoring the electronic tag response signal, beacon signal, or movement.

If a signal is not received from the electronic tag, or motion is detected ("NO" branch of decision block 952), the process 940 may proceed to block 954 and transmit a user RFID tag interrogation signal. The user RFID tag interrogation signal may be a separate signal from the home RFID tag interrogation signal (e.g., having a different frequency or transmitted at a different time than the home RFID tag interrogation signal), or may be single RFID interrogation signal that elicits a response from both the electronic tag and user RFID tags 13 if both tags are within range of the firearm 100. For embodiments of the invention in which the interrogation signal elicits responses from multiple electronic tags, the process 940 may listen for multiple responses (e.g., from the electronic tag and one or more user RFID tags 13) each time the interrogation signal is transmitted, and proceed accordingly based on the response signals received.

If the process 540 receives a response signal from the user RFID tag 13 ("YES" branch of decision block 956), the process 540 may proceed to block 958, and activate the Ready mode so that the firearm 100 is ready for use by the user. Activation of the Ready mode may include enablement of the left behind feature. If the process 540 does not receive a response signal from the RFID tag 13 of an authorized user ("NO" branch of decision block 956), the process 540 may determine that the firearm 100 has been moved by an unauthorized user and proceed to block 960. In block 960, the process 940 may execute a predetermined response protocol. The response protocol may be a default protocol associated with the Home mode, or may be a protocol defined by the user for responding to unauthorized movement of the firearm 100 while in the Home mode in a similar manner as described above with respect to the process 510 depicted in FIG. 5B.

Figure 14:
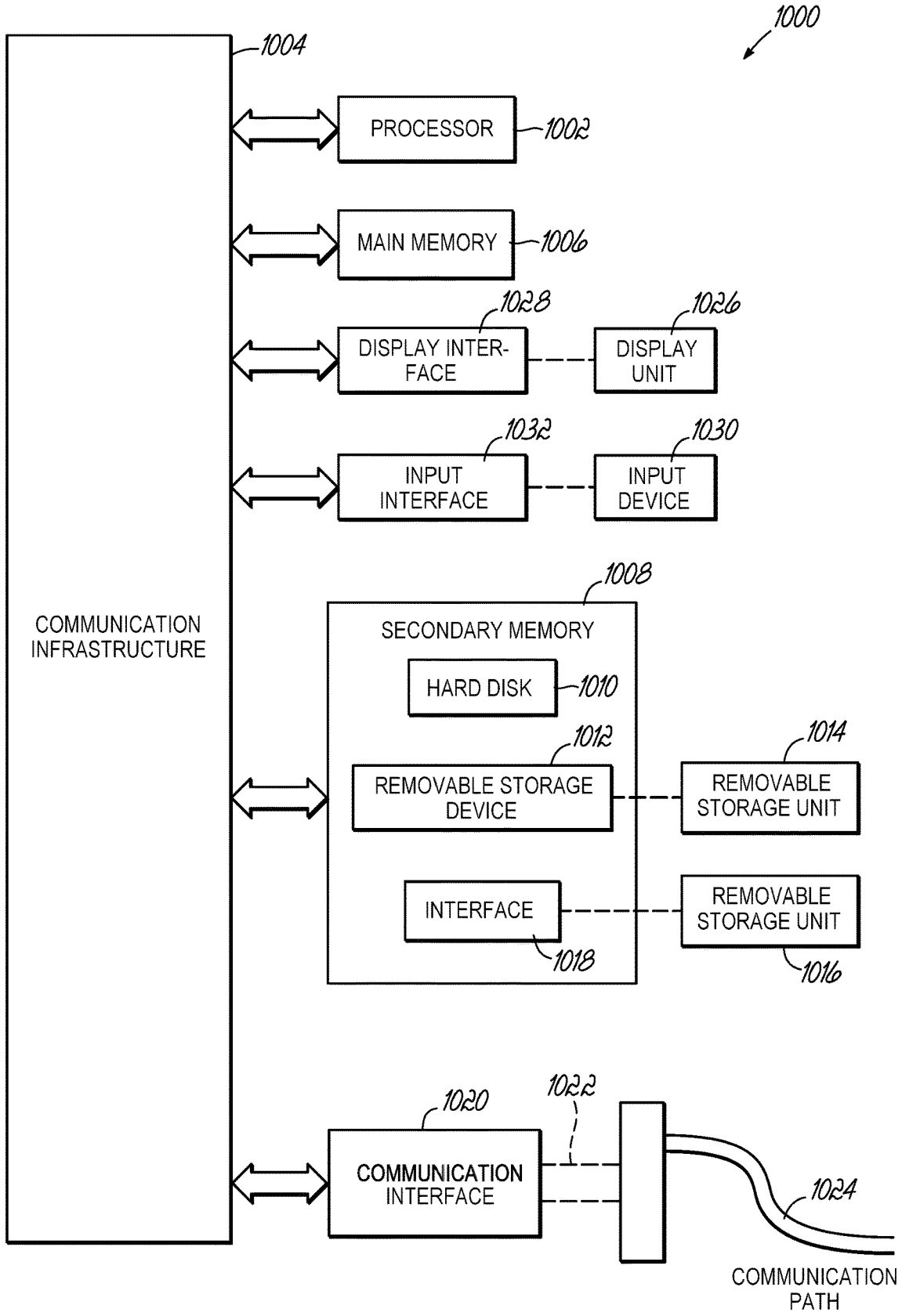
FIG. 14 is a diagrammatic view depicting a block diagram of an exemplary computer system in which embodiments of the disclosed invention, or portions thereof, may be implemented.

FIG. 14 is a block diagram of an exemplary computer system 1000 with which embodiments of the disclosed invention, or portions thereof, may be implemented. That is, system 200 may use one or more components as noted and illustrated which operate under control of computer-readable code, which is executed by one or more processors causing the one or more processors to perform operations of the disclosed invention. For example, all or a portion of the system 200, including but not limited to the remote device 6, secondary identification device 7, RFID tag 13, firearm 100, network server 922, user system 928, network database 930, or any other component of the system 200 may be implemented using one or more computer systems 1000 including hardware, software, firmware, tangible computer readable media having instructions stored thereon, or a combination thereof and may be implemented in one or more computer systems or other processing system.

If programmable logic is used, such logic may be executed on a commercially available processing platform or a special purpose device. One of ordinary skill in the art should appreciate that embodiments of the disclosed subject matter can be practiced with various computer system configurations, including multi-core multiprocessor systems, minicomputers, mainframe computers, computers linked or clustered with distributed functions, as well as pervasive or miniature computers that may be embedded into virtually any device.

Various embodiments of the invention may be described in terms of this example computer system 1000. After reading this description, it will become apparent to persons of ordinary skill in the relevant art how to implement the invention using other computer systems or computer architectures. Although operations may be described as a sequential process, some of the operations may in fact be performed in parallel, concurrently, or in a distributed environment, and with program code stored locally or remotely for access by single or multi-processor machines. In addition, in some embodiments the order of operations may be rearranged without departing from the spirit of the disclosed subject matter.

As will be appreciated by persons of ordinary skill in the relevant art, a computing device for implementing the disclosed invention has at least one processor, such as processor 1002, wherein the processor 1002 may be a single processor, a plurality of processors, a processor in a multi-core/multiprocessor system, such system operating alone, or in a cluster of computing devices operating in a cluster or server farm. Processor 1002 may be connected to a communication infrastructure 1004, for example, a bus, message queue, network, or multi-core message-passing scheme.

Computer system 1000 may also include a main memory 1006, for example, random access memory (RAM) or read-only memory (ROM), and may also include a secondary memory 1008. Secondary memory 1008 may include, for example, a hard disk drive 1010, removable storage drive 1012. Removable storage drive 1012 may include a floppy disk drive, a magnetic tape drive, an optical disk drive, a flash memory, or the like. The removable storage drive 1012 may be configured to read or write data to a removable storage unit 1014. Removable storage unit 1014 may include a floppy disk, magnetic tape, optical disk, etc., which is read by and written to, by removable storage drive 1012. As will be appreciated by persons of ordinary skill in the relevant art, removable storage unit 1014 may include a computer readable storage medium having computer software (i.e., computer program instructions) or data stored thereon.

In alternative implementations, secondary memory 1008 may include other similar devices for allowing computer programs or other instructions to be loaded into computer system 1000. Such devices may include, for example, a removable storage unit 1016 and an interface 1018. Examples of such devices may include a program cartridge and cartridge interface (such as that found in video game devices), a removable memory chip (such as EPROM or PROM) and associated socket, and other removable storage units 1016 and interfaces 1018 which allow software and data to be transferred from the removable storage unit 1016 to computer system 1000.

The processor 1002 may include one or more devices selected from microprocessors, micro-controllers, digital signal processors, microcomputers, central processing units, field programmable gate arrays, programmable logic devices, state machines, logic circuits, analog circuits, digital circuits, or any other devices that manipulate signals (analog or digital) based on operational instructions that are stored in memory 1006, 1008. The processor 1002 may operate under the control of an operating system that resides in memory 1006, 1008. The operating system may manage computer resources so that computer program code embodied as one or more computer software applications, such as an application residing in memory 1006, 1008, may have instructions executed by the processor 1002. One or more data structures may also reside in memory 1006, 1008, and may be used by the processor 1002, operating system, or application to store or manipulate data.

In general, the routines executed to implement the embodiments of the invention, whether implemented as part of an operating system or a specific application, component, program, object, module or sequence of instructions, or a subset thereof, may be referred to herein as "computer program code," or simply "program code." Program code typically comprises computer-readable instructions that are resident at various times in various memory and storage devices in a computer and that, when read and executed by one or more processors in a computer, cause that computer to perform the operations necessary to execute operations or elements embodying the various aspects of the embodiments of the invention. Computer-readable program instructions for carrying out operations of the embodiments of the invention may be, for example, assembly language, source code, or object code written in any combination of one or more programming languages.

Various program code described herein may be identified based upon the application within which it is implemented in specific embodiments of the invention. However, it should be appreciated that any particular program nomenclature which follows is used merely for convenience, and thus the invention should not be limited to use solely in any specific application identified or implied by such nomenclature. Furthermore, given the generally endless number of manners in which computer programs may be organized into routines, procedures, methods, modules, objects, and the like, as well as the various manners in which program functionality may be allocated among various software layers that are resident within a typical computer (e.g., operating systems, libraries, API's, applications, applets, etc.), it should be appreciated that the embodiments of the invention are not limited to the specific organization and allocation of program functionality described herein.

The program code embodied in any of the applications/modules described herein is capable of being individually or collectively distributed as a computer program product in a variety of different forms. In particular, the program code may be distributed using a computer-readable storage medium having computer-readable program instructions thereon for causing a processor to carry out aspects of the embodiments of the invention.

Computer system 1000 may also include a communications interface 1020. Communications interface 1020 may allow software and data to be transferred between computer system 1000 and external devices. Communications interfaces 1020 may include a modem, a network interface (such as an Ethernet card), a communications port, a PCMCIA slot and card, or the like. Software and data transferred via communications interface 1020 may be in the form of signals 1022, which may be electronic, electromagnetic, optical, or other signals capable of being received by communications interface 1020. These signals may be provided to communications interface 1020 via a communications path 1024.

In this document, the terms "computer program storage media" and "computer-readable storage media" are used to generally refer to storage media such as removable storage unit 514, removable storage unit 1016, and a hard disk installed in hard disk drive 1010. Computer program storage media and computer usable storage media may also refer to memories, such as main memory 1006 and secondary memory 1008.

Computer-readable storage media, which is inherently non-transitory, may include volatile and non-volatile, and removable and non-removable tangible media implemented in any method or technology for storage of data, such as computer-readable instructions, data structures, program modules, or other data. Computer-readable storage media may further include RAM, ROM, erasable programmable read-only memory (EPROM), electrically erasable programmable read-only memory (EEPROM), flash memory or other solid state memory technology, portable compact disc read-only memory (CD-ROM), or other optical storage, magnetic cassettes, magnetic tape, magnetic disk storage or other magnetic storage devices, or any other medium that can be used to store data and which can be read by a computer. A computer-readable storage medium should not be construed as transitory signals per se (e.g., radio waves or other propagating electromagnetic waves, electromagnetic waves propagating through a transmission media such as a waveguide, or electrical signals transmitted through a wire). Computer-readable program instructions may be downloaded to a computer, another type of programmable data processing apparatus, or another device from a computer-readable storage medium or to an external computer or external storage device via a network.

Computer system 1000 may further include a display unit 1026 that interacts with communication infrastructure 1004 via a display interface 1028. Computer system 1000 may further include a user input device 1030 that interacts with communication infrastructure 1004 via an input interface 1032. A user input device 1030 may include a mouse, trackball, touch screen, or the like.

Computer programs (also called computer control logic or computer program instructions) may be stored in main memory 1006 or secondary memory 1008. Computer programs may also be received via communications interface 1020. Such computer programs, when executed, may enable computer system 1000 to implement embodiments as described herein. In particular, the computer programs, when executed, may enable processor 1002 to implement the processes of embodiments of the invention, such as the stages in the method illustrated by flowcharts of the FIGS. discussed above. Accordingly, such computer programs represent controllers of the computer system 1000. When an embodiment is implemented using software, the software may be stored in a computer program product and loaded into computer system 1000 using removable storage drive 1012, interface 1018, and hard disk drive 1010, or communications interface 1020.

Any of the flowcharts, sequence diagrams, or block diagrams may include more or fewer blocks than those illustrated consistent with embodiments of the invention. It should also be understood that each block of the block diagrams or flowcharts, or any combination of blocks in the block diagrams or flowcharts, may be implemented by a special purpose hardware-based system configured to perform the specified functions or acts, or carried out by a combination of special purpose hardware and computer instructions.

A database may reside in memory 1006, 1008 and may be used to collect and organize data used by the various systems and modules described herein. The database may include data and supporting data structures that store and organize the data. In particular, the database may be arranged with any database organization or structure including, but not limited to, a relational database, a hierarchical database, a network database, or combinations thereof. A database management system in the form of a computer software application executing as instructions on the processor 1002 may be used to access the information or data stored in records of the database in response to a query, which may be dynamically determined and executed by the operating system, other applications, or one or more modules.

Embodiments may be implemented using software, hardware, or operating system implementations other than those described herein. Any software, hardware, and operating system implementations suitable for performing the functions described herein can be utilized. Embodiments are applicable to both a client and to a server or a combination of both It is also noted that recitations herein of "at least one" component, element, etc., should not be used to create an inference that the alternative use of the articles "a" or "an" should be limited to a single component, element, etc.

It is noted that recitations herein of a component being "programmed" in a particular way, "configured" or "programmed" to embody a particular property, or function in a particular manner, are structural recitations, as opposed to recitations of intended use. More specifically, the references herein to the manner in which a component is "programmed" or "configured" denotes an existing physical condition of the component and, as such, is to be taken as a definite recitation of the structural characteristics of the component.

For the purposes of describing and defining the invention, it is noted that the terms "substantially" and "approximately" and "about" are utilized herein to represent the inherent degree of uncertainty that may be attributed to any quantitative comparison, value measurement, or other representation. The terms "substantially" and "approximately" are also utilized herein to represent the degree by which a quantitative representation may vary from a stated reference without resulting in a change in the basic function of the subject matter at issue.

Having described the subject matter of the invention in detail and by reference to specific embodiments thereof, it is noted that the various details disclosed herein should not be taken to imply that these details relate to elements that are essential components of the various embodiments described herein, even in cases where a particular element is illustrated in each of the drawings that accompany this disclosure. Further, it will be apparent that modifications and variations are possible without departing from the scope of the invention, including, but not limited to, embodiments defined in the appended claims. More specifically, although some aspects of the invention are identified herein as preferred or particularly advantageous, it is contemplated that the invention is not necessarily limited to these aspects. Although various aspects of the claimed subject matter have been described herein, such aspects need not be utilized in combination. It is therefore intended that the appended claims cover all such changes and modifications that are within the scope of the claimed subject matter.

The terminology used herein is for the purpose of describing particular embodiments only and is not intended to be limiting of the embodiments of the invention. As used herein, the singular forms "a", "an" and "the" are intended to include both the singular and plural forms, and the terms "and" and "or" are each intended to include both alternative and conjunctive combinations, unless the context clearly indicates otherwise. It will be further understood that the terms "comprises" or "comprising," when used in this specification, specify the presence of stated features, integers, actions, steps, operations, elements, or components, but do not preclude the presence or addition of one or more other features, integers, actions, steps, operations, elements, components, or groups thereof. Furthermore, to the extent that the terms "includes", "having", "has", "with", "comprised of", or variants thereof are used in either the detailed description or the claims, such terms are intended to be inclusive in a manner similar to the term "comprising".

While all the invention has been illustrated by a description of various embodiments, and while these embodiments have been described in considerable detail, it is not the intention of the Applicant to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the spirit or scope of the Applicant's general inventive concept.

What is claimed is:

1. A system for controlling a firearm, comprising:

the firearm; and an electronic tag including a unique identification associated with an authorized user;

wherein the firearm includes:

a locking device, a firing mechanism that is disabled when the locking device is engaged so that the firearm cannot be fired, and that is enabled when the locking device is disengaged so that the firearm can be fired, a first processor operably coupled to the locking device, and a first memory operably coupled to the first processor and including first program code that, when executed by the first processor, causes the firearm to:

determine if a voice command has been received from the authorized user, if the voice command has been received from the authorized user, determine if the voice command includes an instruction to engage or disengage the locking device, in response to the voice command including the instruction to engage the locking device, engage the locking device, in response to the voice command including the instruction to disengage the locking device, disengage the locking device, and if the voice command has not been received from the authorized user, or does not include the instruction to engage or disengage the locking device:

transmit an interrogation signal configured to elicit a response from the electronic tag, disengage the locking device if the electronic tag responds to the interrogation signal, and engage the locking device if the electronic tag does not respond to the interrogation signal.

2. The system of claim 1 wherein the firearm further comprises a microphone operably coupled to the first processor, and the voice command is received by the microphone.

3. The system of claim 2 wherein the first program code further causes the firearm to:

determine an authenticity of the voice command using voice biometrics; and in response to determining the voice command is authentic, execute the voice command.

4. The system of claim 1 further comprising a remote device including a microphone, the remote device being communicatively coupled to the first processor of the firearm, and the voice command being received by the microphone of the remote device.

5. The system of claim 4 wherein the remote device further includes:

a second processor; and a second memory operably coupled to the second processor and including second program code that, when executed by the second processor, causes the remote device to:

determine an authenticity of the voice command using voice biometrics; and in response to determining the voice command is authentic, transmit the voice command to the first processor of the firearm.

6. A method for controlling a firearm including a locking device and a firing mechanism that is disabled when the locking device is engaged and enabled when the locking device is disengaged, the method comprising:

determining if a voice command has been received from an authorized user at one of the firearm or a remote device;

if the voice command has been received from the authorized user, determining if the voice command includes an instruction to engage or disengage the locking device;

in response to the voice command including the instruction to engage the locking device, engaging the locking device;

in response to the voice command including the instruction to disengage the locking device, disengaging the locking device; and if the voice command has not been received from the authorized user, or does not include the instruction to engage or disengage the locking device:

transmitting, from the firearm, an interrogation signal configured to elicit a response from an electronic tag including a unique identification associated with the authorized user, disengaging the locking device if the electronic tag responds to the interrogation signal, and engaging the locking device if the electronic tag does not respond to the interrogation signal.

7. The method of claim 6 further comprising:

determining an authenticity of the voice command using voice biometrics; and in response to determining the voice command is authentic, executing the voice command.

8. The method of claim 7 wherein the remote device determines the authenticity of the voice command using the voice biometrics, and transmits the voice command to the firearm in response to determining the voice command is authentic.

* * * * *